US009348282B2

(12) United States Patent
Tamura et al.

(10) Patent No.: US 9,348,282 B2
(45) Date of Patent: May 24, 2016

(54) FIXING MEMBER

(71) Applicant: CANON KABUSHIKI KAISHA, Tokyo (JP)

(72) Inventors: Shuichi Tamura, Moriya (JP); Akeshi Asaka, Kashiwa (JP); Hiroto Sugimoto, Toride (JP); Shinsuke Takahashi, Kashiwa (JP); Shigeaki Takada, Abiko (JP); Yutaka Arai, Kawasaki (JP); Jun Miura, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/755,075

(22) Filed: Jun. 30, 2015

(65) Prior Publication Data

US 2016/0018765 A1 Jan. 21, 2016

(30) Foreign Application Priority Data

Jul. 16, 2014 (JP) ..... 2014-145829

(51) Int. Cl.
*G03G 15/20* (2006.01)

(52) U.S. Cl.
CPC ..... *G03G 15/206* (2013.01); *G03G 15/2053* (2013.01); *G03G 15/2057* (2013.01); *G03G 15/2064* (2013.01); *G03G 15/2089* (2013.01); *G03G 2215/2048* (2013.01)

(58) Field of Classification Search
CPC ..... G03G 15/20
USPC ..... 399/333
See application file for complete search history.

(56) References Cited

U.S. PATENT DOCUMENTS 6,002,910 A * 12/1999 Eddy ..... G03G 15/2057 219/216
6,007,657 A * 12/1999 Eddy ..... G03G 15/2057 156/184
6,459,878 B1 * 10/2002 Tomoyuki ..... G03G 15/206 29/895.32
6,952,553 B2 * 10/2005 Sakakibara ..... G03G 15/2064 399/328
6,989,182 B2 * 1/2006 Chen ..... G03G 15/2057 399/333
7,001,653 B2 * 2/2006 Chen ..... G03G 15/2057 399/333
7,008,678 B2 * 3/2006 Chen ..... G03G 15/20 399/333
7,014,899 B2 * 3/2006 Chen ..... G03G 9/08755 399/333
8,369,764 B2 * 2/2013 Sugawara ..... F16C 13/00 399/333
8,380,113 B2 * 2/2013 Natori ..... G03G 15/2057 399/320
8,688,023 B2 * 4/2014 Sekihara ..... G03G 15/206 399/333

(Continued)

FOREIGN PATENT DOCUMENTS

JP 2012-037874 * 2/2012 ..... G03G 15/20
JP 2012-37874 A 2/2012

*Primary Examiner* — Clayton E Laballe
*Assistant Examiner* — Kevin Butler
(74) *Attorney, Agent, or Firm* — Fitzpatrick, Cella, Harper & Scinto

(57) ABSTRACT

A fixing member, includes: a base layer; and a porous elastic layer provided on the base layer and configured to contain a needle-like filler. The elastic layer has a thermal conductivity, with respect to a longitudinal direction thereof, which is 6 times to 900 times a thermal conductivity with respect to a thickness direction thereof. The elastic layer has an open cell rate larger at longitudinal end portions than at a longitudinal central portion.

8 Claims, 12 Drawing Sheets

(56) References Cited

U.S. PATENT DOCUMENTS 8,755,726 B2 * 6/2014 Sugimoto ..... G03G 15/2057 399/329
9,063,491 B2 * 6/2015 Matsunaka ..... G03G 15/2057
2005/0214044 A1 * 9/2005 Sakakibara ..... G03G 15/206 399/333
2009/0003902 A1 * 1/2009 Sakakibara ..... G03G 15/206 399/331
2009/0116886 A1 * 5/2009 Sakai ..... G03G 15/2053 399/331
2011/0091252 A1 * 4/2011 Sekihara ..... G03G 15/206 399/333
2011/0217092 A1 * 9/2011 Sekihara ..... G03G 15/2057 399/328
2014/0255067 A1 * 9/2014 Matsunaka ..... G03G 15/2057 399/333
2014/0301763 A1 * 10/2014 Miura ..... G03G 15/2057 399/333
2015/0071690 A1 * 3/2015 Miyahara ..... G03G 15/206 399/333
2015/0160596 A1 * 6/2015 Asaka ..... G03G 15/2089 399/333

* cited by examiner

FIXING MEMBER

FIELD OF THE INVENTION AND RELATED ART

The present invention relates to a fixing member. This fixing member is usable in an image forming apparatus such as a copying machine, a printer, a facsimile machine and a multi-function machine having a plurality of functions of these machines.

A fixing device mounted in an image forming apparatus of an electrophotographic type includes a pair of fixing members. As this pair of fixing members, it is possible to cite a fixing roller and a pressing roller as an example.

In such a fixing device, in the case where a small-sized recording material is continuously subjected to fixing of a toner image thereon, there is a liability that a region where the fixing roller or the pressing roller does not contact the recording material (hereinafter referred to as a non-passing region) excessively increases in temperature.

Therefore, in a device disclosed in Japanese Laid-Open Patent Application 2012-37874, a needle-like filler is contained in a porous elastic layer of a pressing roller, so that high heat conduction with respect to an axial direction (longitudinal direction) is realized, and pores are dispersed in the elastic layer, so that a low thermal capacity is realized. That is, compatible realization of suppression of the above-described excessive temperature rise and shortening of a rise time is intended to be achieved.

However, when the excessive temperature rise generates at longitudinal end portions of the pressing roller, air in the pores of the elastic layer expands thermally. As a result, the pressing roller thermally expands at the longitudinal end portions compared with a longitudinal central portion. In this way, when the pressing roller thermally expands at the longitudinal end portions, there is a liability that a feeding property of the recording material becomes worse.

SUMMARY OF THE INVENTION

According to an aspect of the present invention, there is provided a fixing member, comprising: a base layer; and a porous elastic layer provided on the base layer and configured to contain a needle-like filler, wherein the elastic layer has a thermal conductivity, with respect to a longitudinal direction thereof, which is 6 times to 900 times a thermal conductivity, with respect to a thickness direction thereof, and wherein the elastic layer has an open cell rate larger at longitudinal end portions than at a longitudinal central portion.

These and other objects, features and advantages of the present invention will become more apparent upon a consideration of the following description of the preferred embodiments of the present invention taken in conjunction with the accompanying drawings.

DESCRIPTION OF EMBODIMENTS

Embodiments of the present invention will be described in detail with reference to the drawings.

(1) Image Forming Portion

Figure 2:
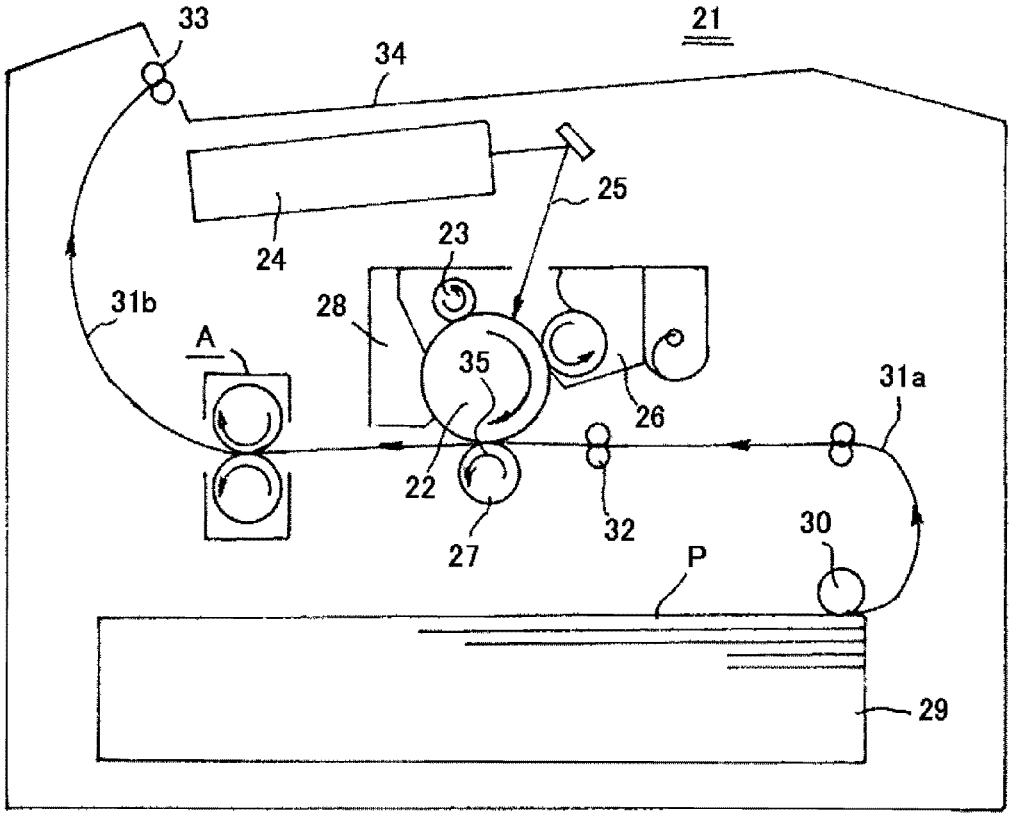
FIG. 2 is a schematic structural view of an example of an image forming apparatus.

FIG. 2 is a schematic sectional view showing a structure of an example of an image forming apparatus 21 in which an image heating apparatus in accordance with the present invention as a fixing device A.

This image forming apparatus 21 is a laser printer of an electrophotographic type and includes a photosensitive drum 22 as an image bearing member for bearing a latent image. The photosensitive drum 22 is rotationally driven in the clockwise direction of an arrow at a predetermined speed, and another surface thereof is electrically charged uniformly to a predetermined polarity and a predetermined potential by a charging device 23. The uniformly charged surface of the photosensitive drum 22 is subjected to laser scanning exposure to light 25 of image information by a laser scanner (optical device) 24. As a result, on the surface of the photosensitive drum 22, an electrostatic latent image of the image information obtained by the scanning exposure is formed.

The electrostatic latent image is developed into a toner image by a developing device 26. The toner image is successively transferred onto a sheet-like recording material (hereinafter referred to as a sheet or paper) P at a transfer portion 35, into which the sheet P is introduced, which is a contact portion between the photosensitive drum 22 and a transfer roller 27.

The sheets P are staked and accommodated in a sheet feeding cassette 29 provided at a lower portion of an inside of a main assembly of the image forming apparatus. When a sheet feeding roller 30 is driven at predetermined timing, one of the sheets P in the sheet feeding cassette 29 is separated and fed, and passes through a feeding path 31*a* to reach a registration roller pair 32. The registration roller pair 32 receives a leading end portion of the sheet P and corrects oblique movement thereof. Further, the sheet P is fed to the transfer portion 35 in synchronism with the toner image on the photosensitive drum 22 so as to provide timing when the leading end portion of the sheet P just reaches the transfer portion 35 when a leading end portion of the toner image on the photosensitive drum 22 reaches the transfer portion 35.

The sheet P passed through the transfer portion 35 is separated from the surface of the photosensitive drum 22 and then is fed to the fixing device A. By this fixing device A, an unfixed toner image on the sheet P is fixed as a fixed image on the sheet surface by heating and pressure application. Then, the sheet P passes through the feeding path 31*b* and then is discharged and stacked by a discharging roller pair 33 on a discharge tray 34 at an upper surface of the image forming apparatus main assembly. The surface of the photosensitive drum 22 after the separation of the sheet is cleaned by removing a residual deposited matter such as a transfer residual toner therefrom by a cleaning device 28, and then is repetitively subjected to image formation.

(2) Fixing Device A

Figure 1:
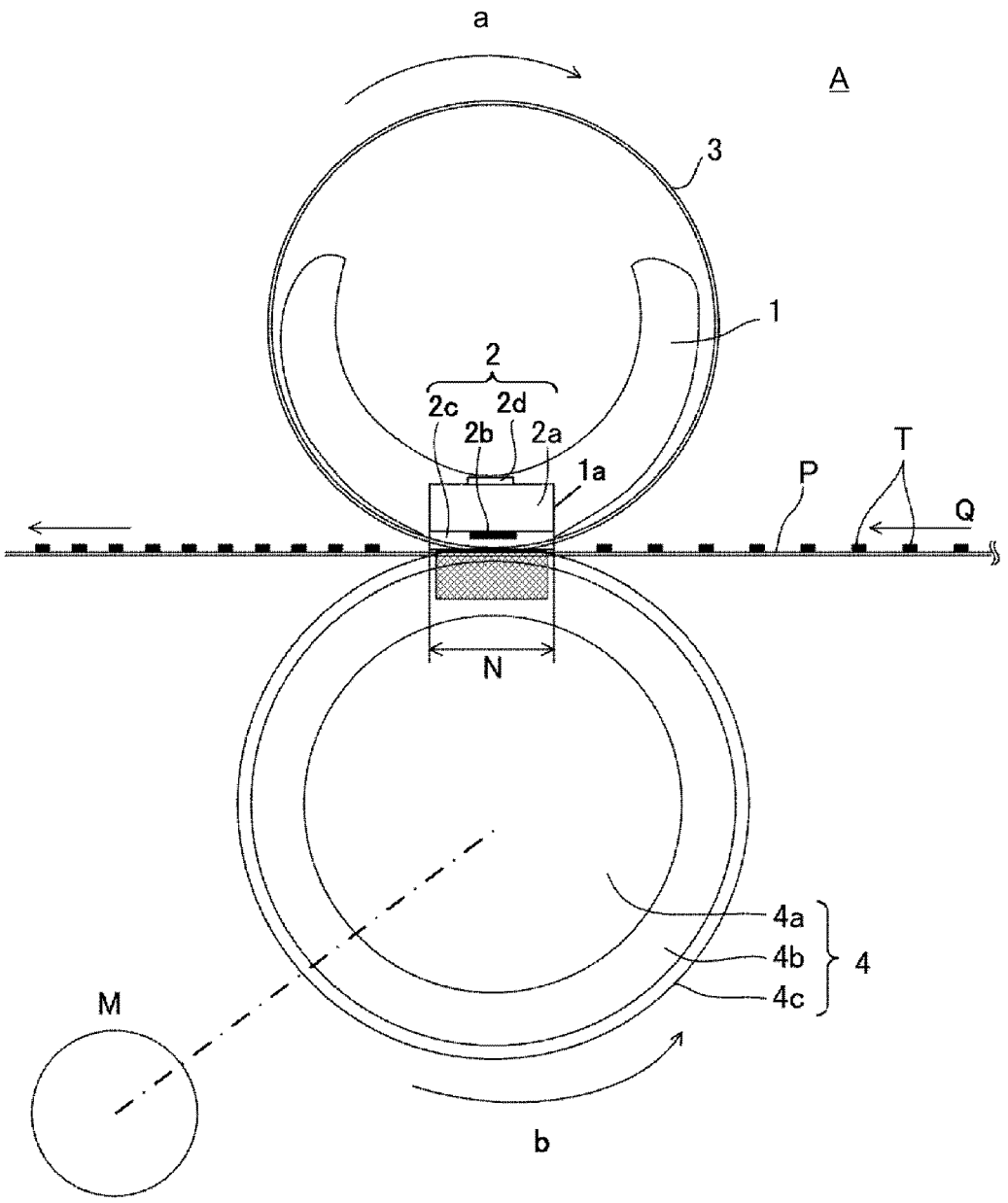
FIG. 1 is a schematic cross-sectional view showing a structure of a fixing device in an embodiment.

FIG. 1 is a view showing a schematic structure of the fixing device A. This fixing device A is an image heating apparatus (device) of a film (belt) heating type, and a schematic structure thereof will be described below.

An elongated film guide member 1 has a trough shape having a substantially semi-circular cross-section and extends in a widthwise direction (longitudinal direction) which is a direction perpendicular to the drawing sheet (of FIG. 1). An elongated heater 2, as a heating member (heating source), accommodated and held in a groove 1*a* formed along the longitudinal direction at a substantially central portion of a lower surface of the film guide member 1. An endless (cylindrical) fixing film (fixing belt) 3 as a fixing member (member for fixing) is loosely fitted around the film guide member 1 in which the heater 2 is mounted. The film guide member 1 is a molded product of a heat-resistant resin material such as PPS (polyphenylenesulfide) or a liquid crystal polymer.

The heater 2 has a constitution in which a heat generating resistor is provided n a ceramic substrate. The heater 2 shown in FIG. 1 includes an elongated thin plate-like heater substrate 2*a* of alumina or the like and a thin strip-like energization heat generating member (heat generating resistor) 2*b* formed of Ag/Pd or the like along the longitudinal direction in the front surface side (film sliding surface side). Further, the heater 2 includes a thin surface protective layer 2*c* such as a gloss layer for covering and protecting the energization heat generating member 2*b*. Further, in the back surface side of the heater substrate 2*a*, a temperature detecting element 2*d* such as a thermistor contacts the heater substrate 2*a*.

The heater 2 quickly increases in temperature by supplying electric power to the energization heat generating member 2*b*, and thereafter can be controlled by an electric power control system including the temperature detecting element 2*d* so as to maintain a predetermined fixing temperature (target temperature).

The fixing film 3 is a composite layer film formed by coating a surface layer on a surface of a base film in a total film thickness of 100 μm or less, preferably 20 μm or more and 60 μm or less in order to improve a quick start property of the fixing device A.

As a material for the base film, a resin material such as PI (polyimide), PAI (polyamideimide), PEEK (polyether ether ketone) or PES (polyethersulfone) or a metal material such as SUS or Ni is used. As a material for the surface layer, a fluorine-containing resin material such as PTFE (polytetrafluoroethylene), PFA (tetrafluoroethylene-perfluoroalkylvinylether) or FEP (fluorinated ethylene propylene resin is used.

A pressing roller 4 as the fixing member has elasticity and forms a nip (fixing nip) N, where the sheet P carrying thereon a toner image T is nipped and fed, by being elastically deformed by press-contact with the fixing film 3 as a heating member.

In the fixing device A shown in FIG. 1, the heater 2 and the pressing roller 4 are disposed in parallel to each other and press-contact the fixing film 3 at a predetermined pressure. As a result, between the fixing film 3 and the pressing roller 4, with respect to a sheet feeding direction (recording material feeding direction) Q, the nip N having a predetermined width necessary to heat-fix the toner image is formed.

The press-contact between the fixing film 3 and the pressing roller 4 may has a constitution in which the pressing roller 4 is press-contacted to the fixing film 3 by a pressing mechanism (unshown) or a constitution in which the fixing film 3 is press-contacted to the pressing roller 4. Further, it is also possible to employ a constitution in which both of the fixing film 3 and the pressing roller 4 are press-contacted to each other at a predetermined pressure.

In the fixing device A shown in FIG. 1, a driving force of a driving source (motor) M is transmitted to the pressing roller 4 via a power transmitting mechanism such as an unshown gear, so that the pressing roller 4 is rotationally driven in the counterclockwise direction of an arrow b at a predetermined peripheral speed. When the pressing roller 4 is rotationally driven, the fixing film 3 is rotated by rotation of the pressing roller 4 in the clockwise direction of an arrow a around the film guide member 1 while sliding on the surface of the surface protective layer 2*c* of the heater 2 in close contact with the surface of the surface protective layer 2*c* in the nip N at an inner surface thereof. A contact time between the fixing film 3 and the pressing roller 4 in the nip N is about 20-80 msec in general.

The sheet P carrying thereon the unfixed toner image T is introduced into the nip N in a state in which the pressing roller 4 is rotationally driven and the fixing film 3 is rotated by rotation of the pressing roller 4, and the heater 2 is increased in temperature by energization and is temperature-controlled at a predetermined temperature. The fixing film 3 faces the toner image carrying surface side (sheet front surface side) of the sheet P, and the pressing roller 4 faces an opposite surface side (sheet back surface side) of the sheet P. The sheet P is nipped and fed at the nip N and is supplied with heat from the heated fixing film 3 during passing thereof through the nip N, so that the sheet P is subjected to pressure application at the nip N. By this heating and pressure application, the unfixed toner image is fixed as a fixed image on the surface of the sheet P.

(3) Pressing Roller 4

Figure 3:
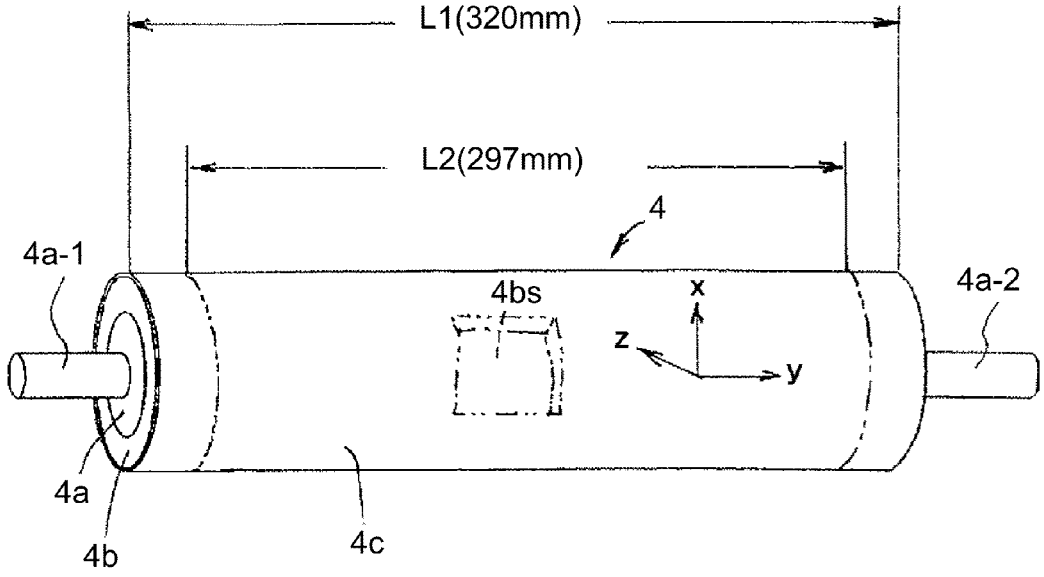
FIG. 3 is a schematic perspective view of a pressing roller.

FIG. 3 is a schematic bird's-eye view (schematic perspective view of an outer appearance) of the pressing roller 4 shown in FIG. 1. The pressing roller 4 shown includes a base material (base layer, core metal) 4*a* of iron, aluminum or the like, and an elastic layer (porous elastic layer) 4*b* consisting of a silicone rubber and containing the needle-like filler and a parting layer (fluorine-containing resin surface layer) 4*c* consisting of a fluorine-containing resin material or the like.

In the following, a circumferential direction (sheet feeding direction) is represented by "x" direction, a widthwise direction (longitudinal direction, axial direction) of the pressing roller 4 is represented by "y" direction, and a thickness direction (layer thickness direction) of constituent layers of the pressing roller 4 is represented by "z" direction. Further, a combination of the circumferential direction x and the widthwise direction y is a planar direction of the pressing roller 4. L1 represents a (widthwise) dimension (widthwise length) of the pressing roller 4. In this embodiment, the length L1 is 320 mm. L2 represents a width (dimension with respect to a row direction perpendicular to the sheet feeding direction on the sheet surface) of a maximum width-sized sheet capable of being introduced into the nip N (fixing device A). In this embodiment, the maximum width sized L2 is a width (297 mm) of a A4-sized sheet fed in a long edge feeding manner on a so-called center(-line) basis.

An outer diameter of the base material 4*a* is, e.g., 4 mm-80 mm. Small-diameter shaft portions 4*a*-1 and 4*a*-2 are provided in one end-side and the other end-side, respectively, of the base material 4*a* with respect to the widthwise direction so as to be concentric with the base material 4*a*. Each of the small-diameter shaft portions 4*a*-1 and 4*a*-2 is a portion rotatably shaft-supported by an unshown fixing portion such as a frame of the fixing device A.

Figure 6:
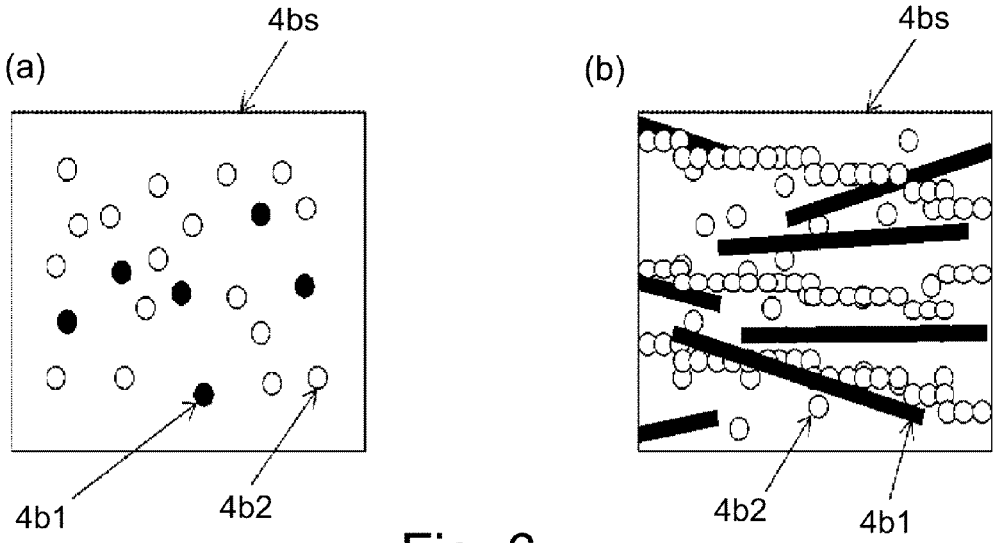
In FIG. 6, (a) is an enlarged sectional view of a-section of the cut sample of FIG. 5, and (b) is an enlarged sectional view of b-section of the cut sample of FIG. 5.

The elastic layer 4*b* is, as shown in schematic views of (a) and (b) of FIG. 6, a porous elastic layer containing a needle-like filler 4*b*1 oriented in the widthwise direction y of the base material 4*a* and a pore 4*b*2. A thickness of the elastic layer 4*b* is not particularly restricted if the nip N having a predetermined width with respect to a sheet feeding direction Q can be formed, but may preferably be 2 mm-10 mm. A thickness of the parting layer 4*c* can be arbitrarily set so long as a sufficient parting property and durability and the like can be imparted to the pressing roller 4. In general, the thickness of the parting layer 4*c* is 20 μm-50 μm.

Figure 4:
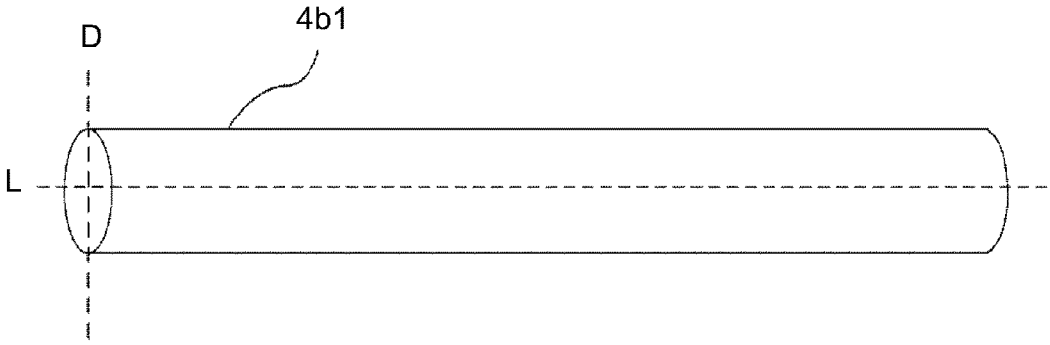
FIG. 4 is a schematic view of a needle-like filler.
Figure 5:
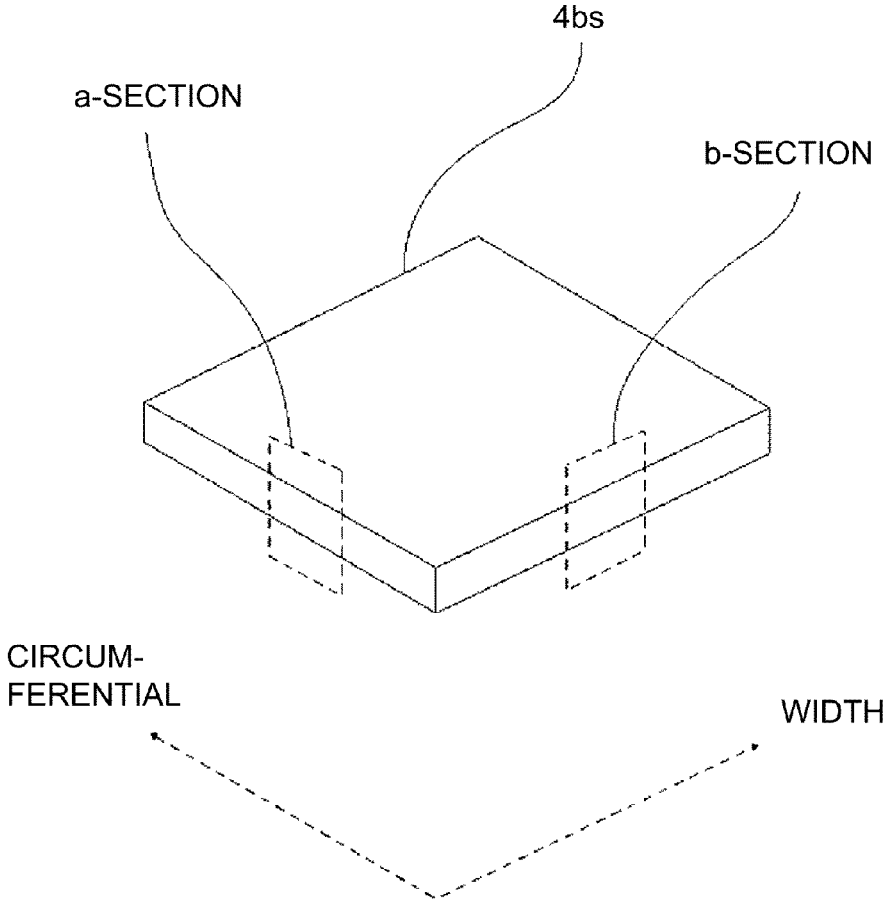
FIG. 5 is an enlarged perspective view of a sample cut from an elastic layer of the pressing roller of FIG. 3.

Using FIGS. 4-6, the elastic layer 4*b* will be described in further detail. FIG. 4 is an enlarged perspective view of the needle-like filler 4*b*1 which is oriented in the widthwise direction y and exists in the elastic layer 4*b* and which has a diameter D and a length L. Incidentally, a physical property and the like of the needle-like filler 4*b*1 will be described later. FIG. 5 is an enlarged view of a cut-out sample 4*bs* cut out from the elastic layer 4*b* shown in FIG. 3. The cut-out sample 4*bs* is cut out along the widthwise direction y and the circumferential direction x as shown in FIG. 3. In FIG. 6, (a) and (b) show a cross section (a-cross section) with respect to the circumferential direction and a cross section (b-cross section) with respect to the widthwise direction, respectively, of the cut-out sample 4*bs*.

In the circumferential cross section (a-cross section) of the cut-out sample 4*bs*, as shown in (a) of FIG. 6, the cross section of a diameter D portion of the needle-like filler 4*b*1 can be principally observed. In the widthwise cross section (b-cross section), as shown in (b) of FIG. 6, a length L portion of the needle-like filler 4*b*1 can be principally observed. The needle-like filler 4*b*1 oriented in the widthwise direction y in the elastic layer 4*b* of the pressing roller 4 constitutes a heat conduction path, so that the thermal conductivity of the pressing roller 4 with respect to the widthwise direction y can be enhanced. Further, in each of (a) and (b) of FIG. 6, the pores 4*b*2 uniformly distributed can be observed.

In this way, a heat conduction property is high with respect to the widthwise direction y of the elastic layer 4*b* by the needle-like filler oriented in the widthwise direction y and the pore 4*b*2 and is low with respect to the thickness direction z by the pore 4*b*2. Further, apparent density lowers by the pore 4*b*2, and therefore volumetric specific heat can be reduced. Incidentally, the apparent density is density based on a volume containing the pores 4*b*2.

As constituent elements for representing features of the elastic layer 4*b*, it is possible to cite a base polymer, the needle-like filler 4*b*1 and the pore 4*b*2. In the following, these elements will be described in order.

(Base Polymer)

The base polymer of the elastic layer 4*b* is obtained by cross-linking and curing an addition curing type liquid silicone rubber. The addition curing type liquid silicone rubber is an uncross-linked silicone rubber including organopolysiloxane (A) having unsaturated bond such as a vinyl group and organopolysiloxane (B) having Si—H bond (hydride). The cross-linking curing proceeds by addition reaction of Si—H with the unsaturated bond such as the vinyl group by heating or the like. As a catalyst for accelerating the reaction, it is in general to incorporate a platinum compound into the organopolysiloxane (A).

Flowability of this addition curing type liquid silicone rubber can be adjusted within a range not impairing an object of the present invention. Incidentally, in the present invention, a filler, a filling material and a compound agent which are not described in the present specification may also be included as a means for solving a known problem so long as amounts of the materials do not exceed ranges of features of the present invention.

(Needle-Like Filler 4*b*1)

The needle-like (elongated fiber-shaped) filler 4*b*1 has thermal conductivity anisotropy that heat is easily conducted in the direction in which the needle-like filler 4*b*1 is oriented (i.e., such a characteristic that the thermal conductivity of the needle-like filler with respect to a long-axis (length) direction is higher than that with respect to a short-axis direction. The "needle-like" refers to a shape having a length with respect to one direction compared with other directions, and the shape can be principally expressed by a short-axis diameter and a long-axis length.

The short-axis diameter (average) is not particularly restricted, but the needle-like filler having the short-axis diameter of 5-15 μm is available relatively easily. Further, the long-axis length (average) may preferably be 0.05 mm-5 mm, more preferably 0.05 mm-1.0 mm.

As shown in FIG. 4, it is possible to use a material having a large ratio of the length L to the diameter D of the needle-like filler, i.e., a high aspect ratio. As a specific shape of the needle-like pitch-based carbon fibers, it is possible to cite a shape of 5-11 μm in diameter D (average diameter) and 50 μm or more and 1000 μm or less in length L (average length) is FIG. 4, for example, and such a material is industrially available easily.

In this embodiment, the filler having the aspect ratio in the range of 4.5-200 is used as the needle-like filler. The shape of the bottom of the needle-like filler may be a circular shape or a rectangular shape and is applicable if the needle-like filler is oriented by a molding method described later.

As such a material, it is possible to cite pitch-based carbon fibers. The pitch-based carbon fibers are fibers manufactured from a by-product, as a raw material, such as petroleum, coal or coal tar by carbonization at high temperature. By incorporating the pitch-based carbon fibers having thermal conductivity λ of 500 W/m·K or more and 900 W/m·K or less, the nip-forming member in the present invention can be suitably used. Further, the pitch-based carbon fibers are a needle-like shape, and therefore features of the nip-forming member in the present invention are suitably exhibited.

The content of the needle-like filler 4*b*1 in the elastic layer 4*b* may preferably be 5 volume % or more and 40 volume % or less in order to obtain an expected non-sheet-passing portion temperature rise suppressing effect without lowing the thermal conductivity of the pressing roller 4 with respect to the widthwise direction and also in order to eliminate difficulty in molding of the elastic layer 4*b*.

The content, the average length and the thermal conductivity of the needle-like filler described above can be obtained in the following manners. In a measuring method of the content (volume %) of the needle-like filler in the elastic layer, first, an arbitrary portion of the elastic layer is cut away, and a volume of the cut-away portion at 25° C. is measured by an immersion specific gravity meter ("SGM-6", manufactured by Mettler-Toredo International Inc.) is used (hereinafter, this volume is referred to as "Vall").

Then, the evaluation sample subjected to the volume measurement is heated at 700° C. for 1 hour in an nitrogen gas atmosphere by using an apparatus for thermogravimetry (trade name: "TGA851e/SDTA", manufactured by Mettler-Toredo International Inc.), so that the silicone rubber component is decomposed and removed. In the case where in addition to the needle-like filler, an inorganic filler is incorporated in the elastic layer, a residual matter after the decomposition is in a state in which the needle-like filler and the inorganic filler exist in mixture.

In this state, the volume at 25° C. is measured a dry-type automatic density meter (trade name: "AccuPyc 13301", manufactured by Shimadzu Corp.) (hereinafter, this volume is referred to as "Va"). Thereafter, the residual matter is heated at 700° C. for 1 hour in an air atmosphere, so that the needle-like filler is thermally decomposed and removed. The volume of the remaining inorganic filler at 25° C. is measured using the dry-type automatic density meter (trade name: "AccuPyc 1330-1", manufactured by Shimadzu Corp.) (hereinafter, this volume is referred to as "Vb"). Based on these values, the weight of the needle-like filler can be obtained from the following equation:

$$\text{Volume (volume \%) of needle-like filler}=\{(Va-Vb)/Vall\}\times 100.$$

The average length of the needle-like filler can be obtained by an ordinary method through microscopic observation of the needle-like filler after the removal of the silicone rubber component by heat described above.

The thermal conductivity of the needle-like filler can be obtained from thermal diffusivity, specific heat at constant pressure and density by the following formula:

$$\text{Thermal conductivity}=\text{Thermal diffusivity}\times\text{Specific heat at constant pressure}\times\text{Density}.$$

The thermal diffusivity is obtained by a laser flash method thermal constant measurement system (trade name: "TC-7000", ADVANCE RIKO, Inc.). The specific heat at constant pressure is obtained by a differential scanning calorimeter (trade name: "DSC823e", manufactured by Hitachi High-Tech Science Corp.). The density is obtained by the dry-type automatic density meter (trade name: "AccuPyc 1330-1", manufactured by Shimadzu Corp.).

Incidentally, with respect to each of the content, the average length and the thermal conductivity of the needle-like filler in this embodiment, an average of measured values of 5 cut-out samples is employed.

(Pore **4*b*2**)

In the elastic layer **4*b*, the oriented needle-like filler 4*b*1 and the pore 4*b*2** are co-exist.

Depending on a pore-forming means such as a foaming agent or hollow particles, needle-like filler orientation inhibition generated in some cases. An orientation state of the needle-like filler **4*n*1** dominates the thermal conductivity with respect to the widthwise direction, and therefore when the orient is inhibited, an effect of suppressing the non-sheet-passing portion temperature rise is unpreferably lowered.

On the other hand, in the case where the pore is formed by using the water-containing material, a degree of the orientation inhibition of the needle-like filler co-existing with the water-containing material can be reduced. A mechanism for compatibly realizing the orientation of the needle-like filler **4*b*1** in the widthwise direction y and the pore formation is not clarified.

However, there is no hard shell such as the hollow particles described above and a diameter of the pore in a water-containing gel dispersion state can be made small, and therefore it would be considered that the influence on the orientation inhibition of the needle-like filler **4*b*1** during the flow is small. Incidentally, from the viewpoints of strength and image quality, a pore diameter may preferably be less than 20 μm.

A porosity of the elastic layer **4*b*** may preferably be 10 volume % or more and 70 volume % or less in order to obtain an expected rise time shortening effect and in order to eliminate difficulty in molding. When the porosity is high, the rise time can be shortened, so that the porosity may more preferably be 35 volume % or more and 70 volume % or less.

The porosity in a region from a surface of the elastic layer **4*b* to a position of 500 μm in depth from the surface can be obtained by a formula shown below. First, using a razor, the region from the surface of the elastic layer 4*b*** to the position of 500 μm in depth from the surface in an arbitrary plane is cut away. A volume of the cut-away region at 25° C. is measured by the immersion specific gravity meter ("SGM-6", manufactured by Mettler-Toredo International Inc.) is used ("Vall" described above). Then, the evaluation sample subjected to the volume measurement is heated at 700° C. for 1 hour in an nitrogen gas atmosphere by using an apparatus for thermogravimetry (trade name: "TGA851e/SDTA", manufactured by Mettler-Toredo International Inc.). As a result, the silicone rubber component is decomposed and removed (Hereinafter, a decrease in weight at this time is referred to as "Mp").

In the case where in addition to the needle-like filler, an inorganic filler is incorporated in the elastic layer, a residual matter after the decomposition is in a state in which the needle-like filler and the inorganic filler exist in mixture.

In this state, the volume at 25° C. is measured the dry-type automatic density meter (trade name: "AccuPyc 13301", manufactured by Shimadzu Corp.) ("Va" described above).

Based on these values, the porosity (pore amount) can be obtained from the formula shown below. Incidentally, the density of the silicone polymer was 0.97 g/m$^3$ for calculation (hereinafter, this density is referred to as "ρp").

$$\text{Porosity (volume \%)}=[\{Vall-(Mp/\rho p+Va)\}/Vall]\times 100$$

Further, the porosity of the elastic layer **4*b* can be measured similarly as described above by cutting away a sample from the elastic layer 4*b*** in an arbitrary plane. Incidentally, as the porosity in this embodiment, an average of measured values of 5 cut-away samples is employed.

(Checking Method of Open Cell Rate)

In order to prevent excessive thermal expansion due to heated air in the pores, the porous elastic layer **4*b*** is in an open-cell state in which the pores in the elastic layer are connected with each other, so that the heated air inside the pores during the temperature rise is dissipated and thus the excessive thermal expansion can be suppressed.

An open cell rate of a porous material of the porous elastic layer **4*b* of the pressing roller 4** with respect to the longitudinal direction may preferably be 40% or more and 90% or less for ensuring desired elasticity in order to suppress the excessive thermal expansion in the pressing roller end portion side with the non-sheet-passing portion temperature rise.

A cell (pore **4*b*2) in this embodiment is fine, and therefore water does not readily enter the cell. Therefore, the parting layer 4*c* is peeled off from the elastic layer 4*b*, and then only the elastic layer 4*b* which is the silicone rubber porous material is taken out, and a weight (elastic layer weight before water absorption) of the elastic layer 4*b*** is measured.

This elastic layer **4*b*** is dipped in an mixture solution of 100 wt. parts of water and 1 wt. part of hydrophilic silicone oil (polyester-modified silicone oil, "KF-618", manufactured by Shin-Etsu Chemical Co., Ltd.) and then is left standing for 10 minutes under reduced pressure (70 mmHg).

Thereafter, the pressure is returned to atmospheric pressure, and the elastic layer 4*b* is taken out from the mixture solution, and then the water adhering to the elastic layer surface is wiped off cleanly and then the weight (elastic layer weight after water absorption) of the elastic layer 4*b* is measured. From the following formulas, a water absorption rate, the open cell rate and a single (closed) cell rate are calculated, respectively.

Water absorption rate (%)={(elastic layer weight after water absorption−elastic layer weight before water absorption)/elastic layer weight before water absorption×100

Open cell rate (%)=(elastic layer specific gravity×water absorption rate/100)/{mixture solution specific gravity−(elastic layer specific gravity/(silicone rubber specific gravity+needle-like filler specific gravity)×water absorption solution specific gravity}×100

Single cell rate (%)=100−open cell rate (%)

(Ratio of Widthwise Direction Thermal Conductivity λ1 to Thickness Direction Thermal Conductivity λ2)

The elastic layer 4*b* has a ratio λ1/λ2 which is a ratio of the widthwise direction thermal conductivity λ1 to the thickness direction thermal conductivity λ2 (hereinafter, this ratio is referred to a "thermal conductivity ratio α) of 6 or more and 900 or less. That is, the needle-like filler 4*b*1 is oriented in the elastic layer so that the thermal conductivity λ1 of the elastic layer 4*b* with respect to the longitudinal direction is 6 times or more and 900 times or less the thermal conductivity λ2 of the elastic layer 4*b* with respect to the thickness direction.

When the thermal conductivity ratio α is less than 6, the non-sheet-passing portion temperature rise suppressing effect cannot be obtained sufficiently in some cases, and in order to increase the thermal conductivity ratio α to more than 900, the amount and the porosity of the needle-like filler are increased, so that it is difficult to effect machining and molding.

With a higher thermal conductivity ratio, heat dissipation in the thickness direction z is suppressed while uniformizing the heat with respect to the widthwise direction y, and therefore the higher thermal conductivity ratio is suitable for shortening the rise time while suppressing the non-sheet-passing portion temperature rise.

Incidentally, the thermal conductivity ratio α can be obtained in the following manner. First, cut-away samples 4*bs* (FIG. 5) of the elastic layer 4*b* were cut out from the pressing roller 4 with a razor. Then, by a method described below, the widthwise direction thermal conductivity λ1 and the thickness direction thermal conductivity λ2 were measured 5 times, and an average of measured values of each of the thermal conductivity λ1 and the thermal conductivity λ2 was used, so that a ratio of λ1 to λ2 was calculated.

Figure 7:
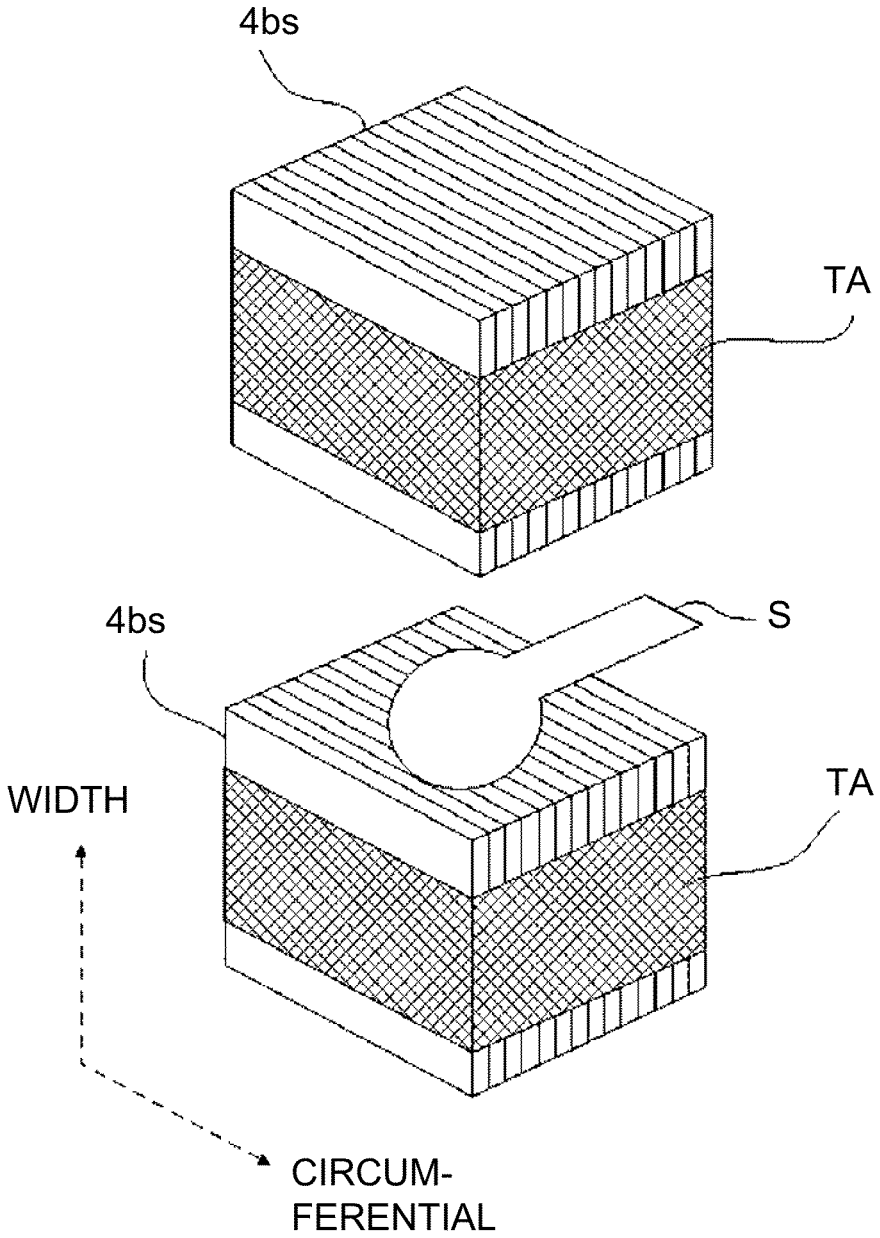
FIG. 7 is an illustration of thermal conductivity measurement of the cut sample of an elastic layer.

Using FIG. 7, the measurement of the widthwise direction thermal conductivity λ1 and the thickness direction thermal conductivity λ2 of the elastic layer 4*b* will be described. FIG. 7 shows a sample for thermal conductivity evaluation prepared by superposing cut-out samples 4*bs* each having a size of 15 mm (circumferential direction)×15 mm (widthwise direction)×elastic layer thickness (thickness direction) so as to have a thickness of about 15 mm. When the widthwise direction thermal conductivity λ1 was measured, as shown in FIG. 7, the sample to be measured was fixed by a tape TA of 0.07 mm in thickness and 10 mm in width to prepare a set of the samples 4*bs*. Then, in order to uniformize flatness of the surface to be measured, the surface to be measured and an opposite surface thereof are cut with the razor.

In this way, two sample sets to be measured are prepared, and a sensor S is sandwiched between the two sample sets, and then measurement was made. The measurement is anisotropic thermal conductivity measurement using a hot disk method thermophysical property measuring device ("TPA-501, manufactured by Kyoto Electronics Manufacturing Co., Ltd.). In the measurement of the thickness direction thermal conductivity λ2, the direction of the sample to be measured was changed and then the measurement was made in the same manner as described above.

(Volume Specific Heat in Region from Surface of Elastic Layer 4*b* to Position of 500 μm in Depth from Elastic Layer Surface)

The elastic layer 4*b* has volume specific heat, in a region from the surface of the elastic layer 4*b* to a position of 500 μm in depth from the elastic layer surface, of 0.5 J/cm$^3$·K or more and 1.2 J/cm$^3$·K or less. With a lower volume specific heat, the rise time can be shortened, and therefore the volume specific heat may preferably be 0.5 J/cm$^3$·K or more and 1.0 J/cm$^3$·K or less. A thermal osmosis distance (depth) of the pressing roller 4 to be subjected to repetitive heating for a short time (20-80 msec in general) at the nip N is shallow, and is about 500 μm in depth from the surface of the elastic layer 4*b*. In that thickness region, the volumetric specific heat is made small, so that heat accumulation from the fixing film 3 into the pressing roller 4 is prevented and thus the fixing film 3 can be efficiently increased in temperature and it is possible to shorten the rise time.

When the volumetric specific heat is less than 0.5 J/cm$^3$·K, the porosity is required to be made large and thus it is difficult to effect machining and molding. When the volumetric specific heat is more than 1.2 J/cm$^3$·K, an expected rise time shortening effect cannot be obtained in some cases.

The volumetric specific heat in the region from the surface of the elastic layer 4*b* of the pressing roller 4 to the position of 500 μm in depth from the elastic layer surface can be obtained in the following manner.

First, an evaluation sample (unshown) is cut out so as to have a depth of 500 μm from the surface of the elastic layer 4*b* of the pressing roller 4. Then, measurement of specific heat at constant pressure and measurement of immersion specific gravity are made. The specific heat at constant pressure can be obtained, e.g., by the differential scanning calorimeter (trade name: DSC823e, manufactured by Mettler-Toredo International Inc.). Further, the apparent density can be obtained using, e.g., the immersion specific gravity meter ("SGM-6", manufactured by Mettler-Toredo International Inc.). From the thus-measured specific heat at constant pressure and apparent density, the volumetric specific heat can be obtained by the following formula:

Volume specific heat=specific heat at constant pressure×apparent density.

(4) Manufacturing Method of Pressing Roller 4

(i) Liquid Composition Compounding Step

The above-described needle-like filler 4*b*1 and a water-containing material obtained by incorporating water in a water-absorptive polymer are compounded with an uncrosslinked addition-curing type silicone rubber. The compounding can be made by weighing a predetermined of each of the uncrosslinked addition-curing type silicone rubber, the needle-like filler 4*b*1 and the water-containing material and then by dispersing the needle-like filler 4*b*1 in the mixture by a known filler mixing and stirring means such as a planetary universal mixing and stirring device. The liquid composition in which the water-containing material is compounded has a compounding ratio of 10%-70%.

(ii) Liquid Composition Layer Forming Step (Casting Step)

1) Metal Mold

Figure 8:
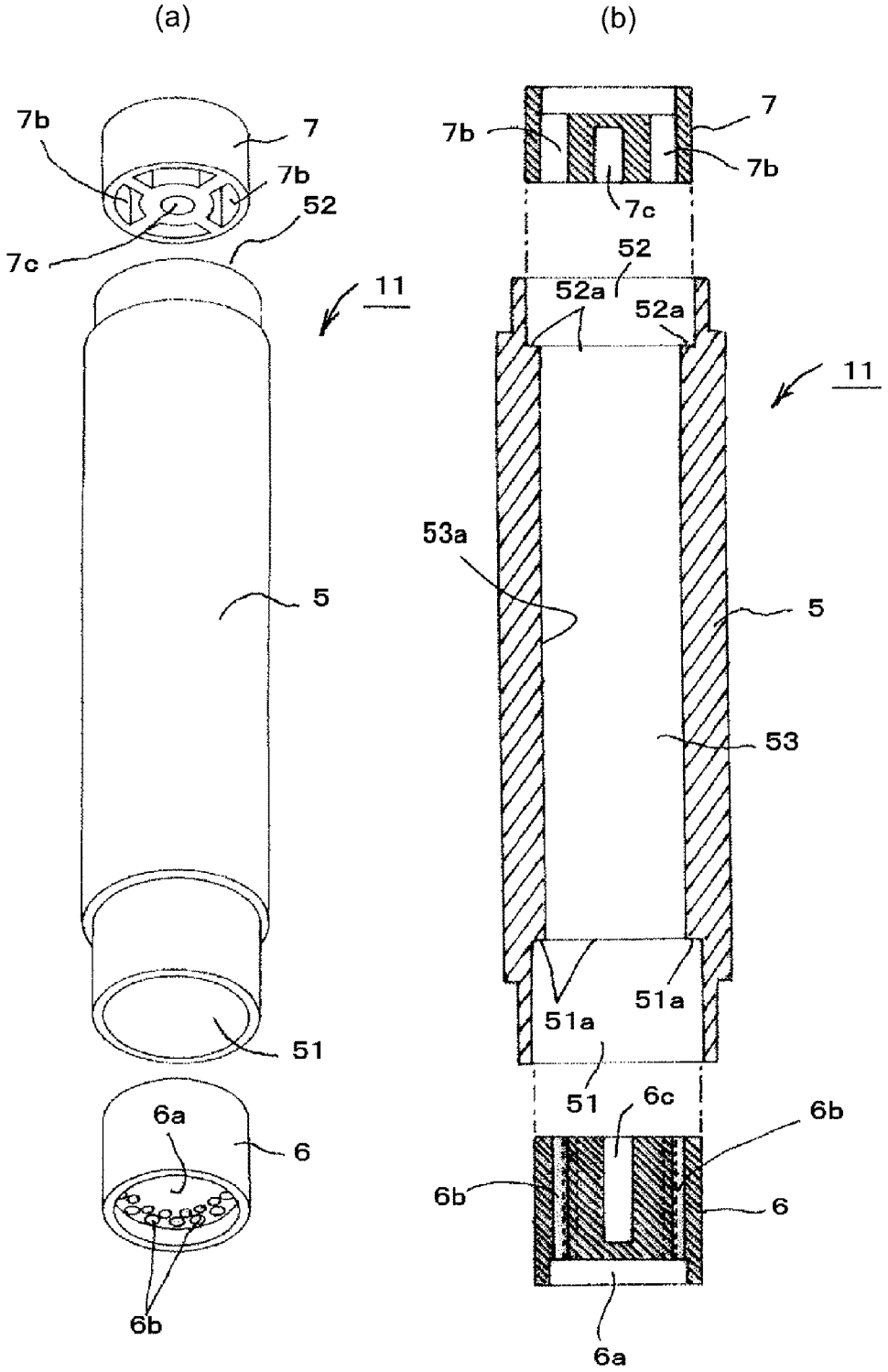
In FIG. 8, (a) and (b) are illustrations of a structure of a metal mold.

In FIG. 8, (a) is an exploded perspective view of a metal mold 11 used in casting manufacturing of the pressing roller 4 in this embodiment, and (b) is a longitudinal sectional view of a hollow metal mold 5, a one end-side piece mold (inserting mold) 6 and the other end-side piece mold (inserting mold) 7, which constitute the metal mold 11. The metal mold 11 includes the hollow metal mold (hollow cylindrical metal mold, pipe-like cylindrical mold) 5 having a cylindrical molding space (hereinafter referred to as a cavity) 53, and the one end-side piece mold 6 and the other end-side piece mold 7 mounted into a one end-side opening 51 and the other end-side opening 52, respectively, of the hollow metal mold 5.

The one end-side piece mold 6 is a piece mold for permitting injection of the liquid rubber into the cavity 53 of the hollow metal mold 5. The other end-side piece mold 7 is a piece mold for permitting discharge of air pushed out from the inside of the cavity 53 with the injection of the liquid rubber into the cavity 53.

Figure 9:
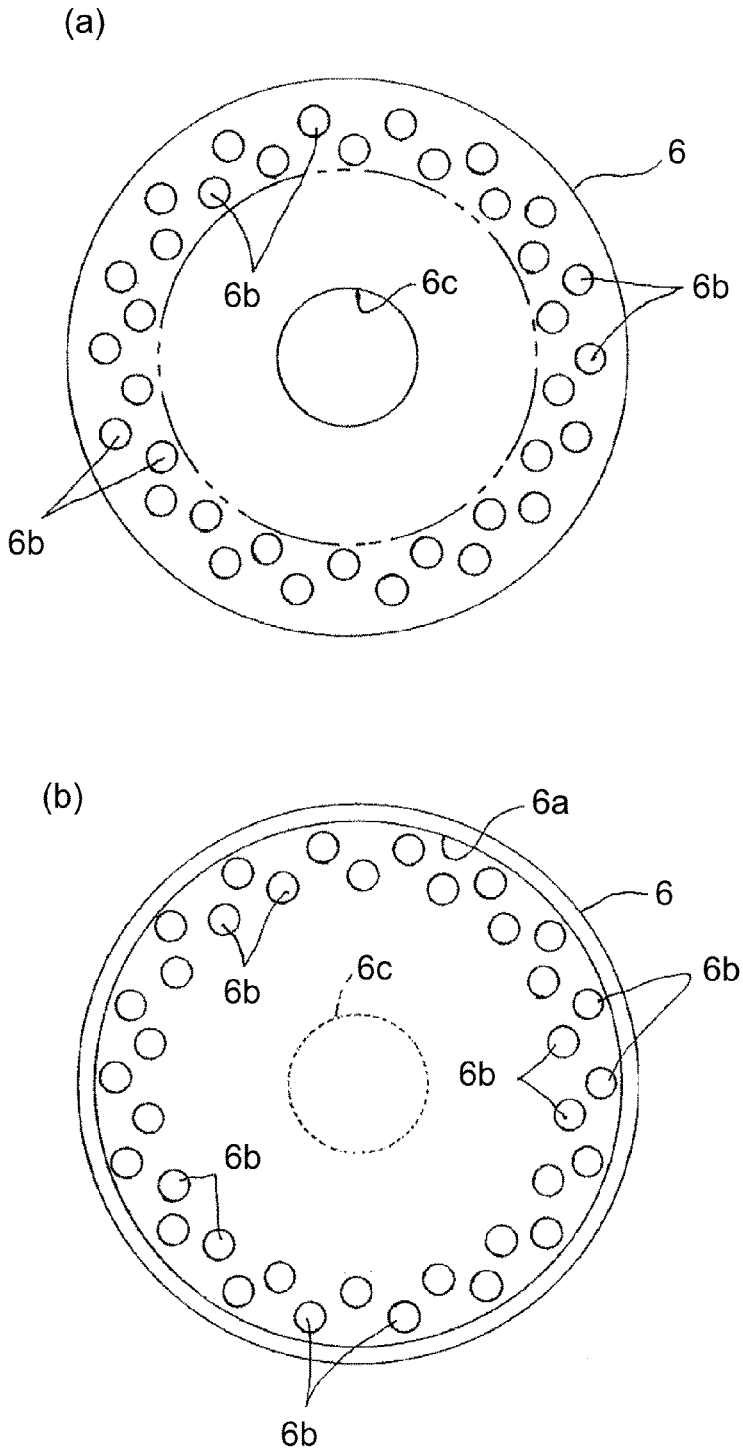
In FIG. 9, (a) and (b) show a shape of injection holes provided in one end-side piece mold (inserting mold).

In FIG. 9, (a) is an inner surface view (cavity-side end surface view) of the one end-side piece mold 6, and (b) is an outer surface view (end surface view in a side opposite from the cavity side) of the one end-side piece mold 6. At a central portion of the one end-side piece mold 6 in an inner surface side, a central hole 6*c* as a base material holding portion into which the one end-side small-diameter shaft portion 4*a*-1 of the base material 4*a* is to be inserted is provided. Further, in the outer surface side, a circumferential hole (hollow, recessed portion) 6*a* is provided. Further, the circumferential hole 6*a* is provided with a plurality of liquid rubber mixture injection holes 6*b* which are disposed from the outer surface side to the inner surface side along a circumference of the circumferential hole 6*a*.

Further, at an inner surface central portion (cavity-side end surface central portion) of the other end-side piece mold 7, a central hole 7*c* as a base material holding portion into which the other end-side small-diameter shaft portion 4*a*-2 of the base material 4*a* is to be inserted is provided. Then, a plurality of discharging holes 7*b* are provided from the inner surface side to the outer surface side.

The one end-side piece mold 6 is engaged into the one end-side opening 51 from the inner surface side and is inserted sufficiently until a circumferential edge portion in the inner surface side is abutted against and received by a circular stepped portion 51*a* on an inner peripheral surface of the opening, so that the one end-side piece mold 6 is mounted in the one end-side of the hollow metal mold 5. Further, the other end-side piece mold 7 is engaged into the other end-side opening 52 from the inner surface side and is inserted sufficiently until a circumferential edge portion in the inner surface side is abutted against and received by a circular stepped portion 52*a* on an inner peripheral surface of the opening, so that the one end-side piece mold 6 is mounted in the other end-side of the hollow metal mold 5.

2) Placement of Base Material in Metal Mold

The base material 4*a* was subjected to known primer treatment in advance at a portion where the rubber elastic layer 4*b* is to be formed. In the case where the elastic layer 4*b* and the base material 4*a* are interlayer-bonded to each other, the primer may also be not used.

Figure 10:
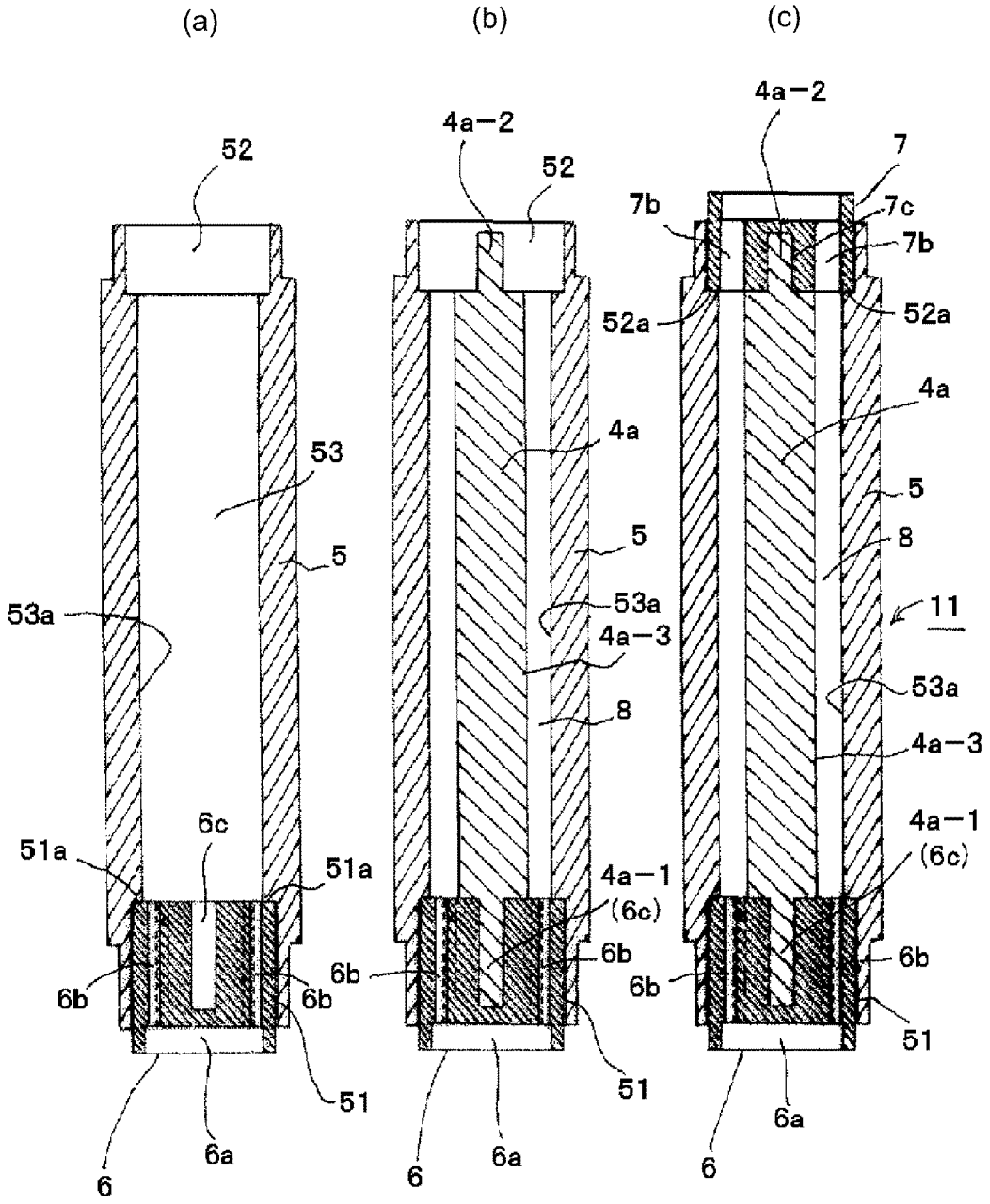
In FIG. 10, (a)-(c) are illustrations of a manner of mounting a roller base material in the metal mold.

As shown in (a) of FIG. 10, the one end-side piece mold 6 is mounted into the one end-side opening 51 of the hollow metal mold 5. Then, as shown in (b) of FIG. 10, the above-described base material 4*a* is inserted into the hollow metal mold 5 through the other end side opening 52 from the one end-side small-diameter shaft portion 4*a*-1 side, and then the small-diameter shaft portion 4*a*-1 is inserted into and supported by the inner surface-side central hole 6*c* of the one end-side piece mold 6.

Then, as shown in (c) of FIG. 10, the other end-side piece mold 7 is mounted into the hollow metal mold 5 through the other end side opening 52 in a state in which the other end-side small-diameter shaft portion 4*a*-2 of the base material 4*a* is inserted into and supported by the inner surface-side central hole 7*c*.

As a result, the base material 4*a* is concentrically positioned and held at the cylindrical central portion of the cylindrical cavity 53 of the metal mold 5 in a state in which the one end-side and the other end-side small-diameter shaft portions 4*a*-1 and 4*a*-2 are supported by the central holes 6*c* and 7*c* of the one end-side and the other end-side piece molds 6 and 7, respectively. Further, between a cylinder molding surface (inner peripheral surface) 53*a* of the cylindrical cavity 53 and an outer surface (outer peripheral surface) 4*a*-3 of the base material 4*a*, a gap (spacing) 8 for permitting cast molding of the rubber elastic layer 4*b* having a predetermined thickness is formed around the outer periphery of the base material 4*a*.

Incidentally, the placement of the base material 4*a* in the cavity 53 of the metal mold 11 is not limited to the above-described procedure. The hollow metal mold 5, the base material 4*a*, the one end-side piece mold 6 and the other end-side piece mold 7 may only be finally assembled as shown in (c) of FIG. 10.

3) Mounting of Metal Mold 11

Figure 11:
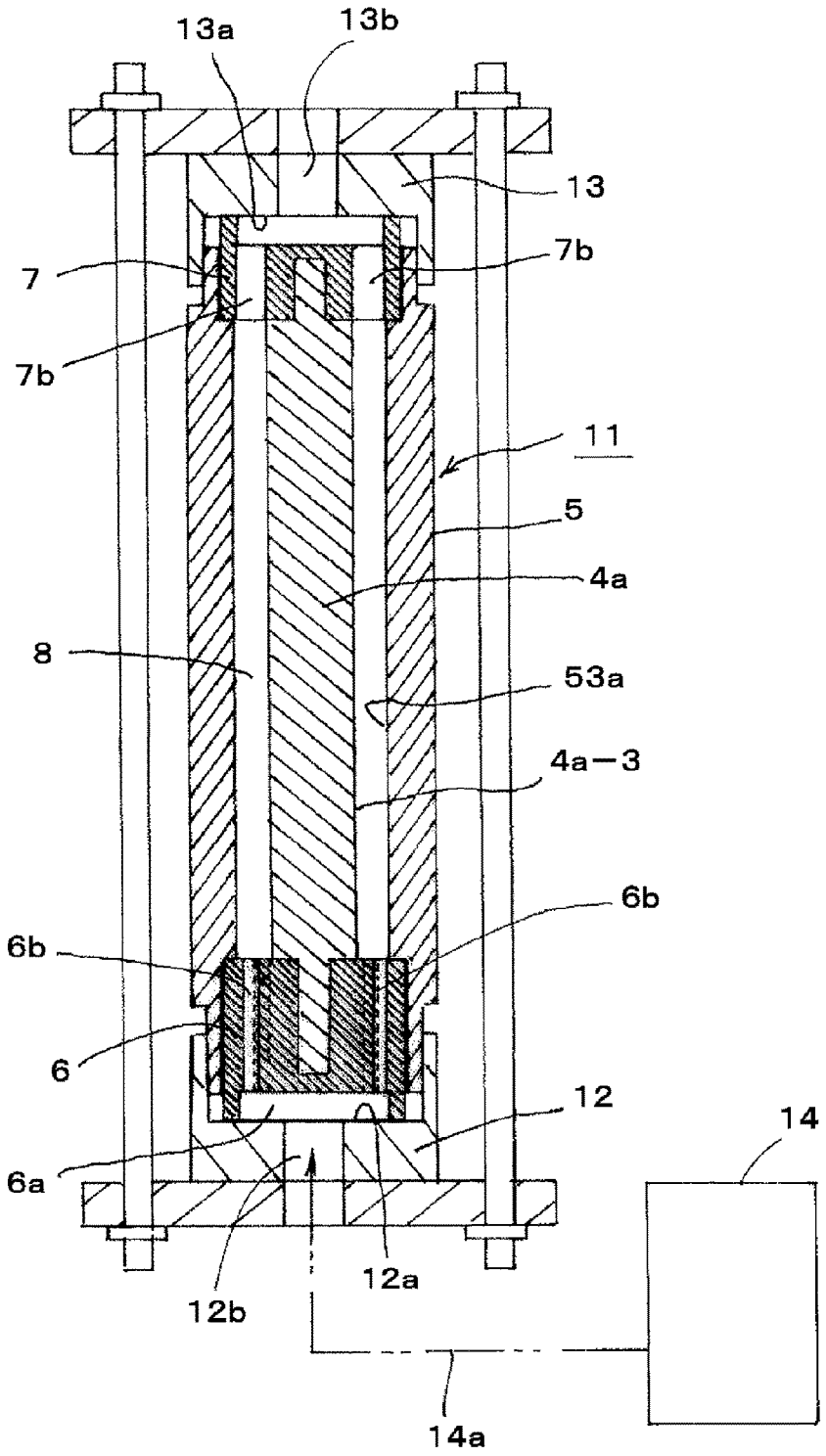
FIG. 11 is an illustration of an injection step.

The metal mold 11 in which the base material 4*a* is provided in the cavity 53 as described above is, as shown in FIG. 11, pressed and fixedly held in a vertical attitude between a lower-side jig 12 and an upper-side jig 13 which oppose each other while the one end-side piece mold 6 side is a lower side and the other end-side piece mold 7 side is an upper side. The one end-side piece mold (hereinafter referred to as a lower piece mold) 6 of the metal mold 11 is engaged into and received by a receiving hole 12*a* of the lower-side jig 12. The other end-side piece mold (hereinafter referred to as an upper piece mold) 7 of the metal mold 11 is engaged into and received by a receiving hole 13*a* of the upper-side jig 13.

That is, the metal mold 11 is fixedly held between the lower-side jig 12 and the upper-side jig 13 in an attitude state in which a cylindrical axial line of the cylindrical cavity 53 is vertically directed and a side where the injection holes 6*b* are disposed is the lower side, and then a casting step is performed. At a central portion of the receiving hole 12*a* of the lower-side jig 12, a liquid composition injection port 12*b* is provided. To the liquid composition injection port 12*b*, a liquid composition supplying pipe 14*a* of an external liquid composition supplying device 14 is connected. At a central portion of the receiving hole 13*a* of the upper-side jig 13, a discharging port 13*b* is disposed.

4) Injection of Liquid Composition

The supplying device 14 is driven, and the liquid composition of (i) described above passes through the supplying pipe 14*a* and enters the receiving hole 12*a* through the injection port, so that the liquid composition is filled in a space portion constituted by the receiving hole 12*a* and the circumferential hole 6*a* in the outer surface side of the lower piece mold 6. With subsequent supply of the liquid composition, the filled liquid composition passes through the plurality of injection holes 6*b* provided along the circumference of the circumferential hole 6*a* and flows from the outer surface side toward the inner surface side of the lower piece mold 6. Then, the liquid composition is injected into the gap 8 formed between the cylinder molding surface 53*a* of the cavity 53 and the outer surface 4*a*-3 of the base material 4*a*.

With further subsequent supply of the liquid composition, the injection of the liquid composition into the gap 8 has advanced from below to above. Air existing in the gap 8 is pushed up from below in the gap 8 with the injection of the liquid composition into the gap 8 from below toward above, so that the liquid composition passes from the gap 8 through a discharging hole 7*b* of the upper piece mold 7 and the discharging port 13*b* of the upper-side jig 13, and comes out of the metal mold 11.

The injection of the liquid composition into the gap 8 through the respective injection holes 6*b* of the lower-side piece mold 6 is averagely made with respect to a circumferential direction of the gap 8. In addition, the base material 4*a* is in a state in which the base material 4*a* is concentrically fixed at the cylindrical central portion of the cavity 53 by the upper and lower members 7 and 6, and is not moved by the injection of the liquid composition, so that the gap 8 can be filled with the liquid composition adequately without generating thickness deviation (non-uniformity).

In the above-described manner, the liquid composition is casted in the metal mold 11 in which the base material 4*a* is disposed while providing flowability in the widthwise direction y and the circumferential direction x. By this flow of the liquid composition during the injection, most of the needle-like filler 4*b*1 contained in the liquid composition is oriented in the widthwise direction y of the base material 4*a*, i.e., the longitudinal direction (y direction) of the pressing roller 4 along the flow of the liquid composition. As a result, the thermal conductivity of the pressing roller 4 with respect to the widthwise direction y and the circumferential direction x (planar direction xy) is effectively enhanced.

The injection of the liquid composition into the metal mold 11 is performed at least until the gap 8 is sufficiently filled with the liquid composition. The discharging hole 7*b* of the upper piece mold 7 is not required to the sufficiently filled with the liquid composition. Incidentally, the liquid composition layer forming method is not restricted to the above method if the method is a method capable of forming a layer while giving flowability to the liquid in the widthwise direction y.

(iii) Silicone Rubber Component Cross-Linking Curing Step (Primary Vulcanizing Step)

In the step, the rubber in the liquid composition layer is cross-linked in a state in which the water in the water-containing material is maintained. This step is performed in a hermetically sealed state of the metal mold 11. That is, after the injection of the liquid composition (after the end of the casting step), the metal mold 11 is demounted from the upper and lower jigs 13 and 12. At this time, outer openings of the lower piece mold 6 and the upper piece mold 7 are hermetically sealed by mounting of a blind plate so that the injected liquid rubber does not flow through the outer openings of the lower piece mold 6 and the upper piece mold 7. Then, in the hermetically sealed state of the metal mold 11, heat treatment is made at a temperature of not more than a boiling point of water for 5 minutes to 120 minutes. As a heat treatment temperature, 60° C. to 90° C. is desirable, so that the silicone rubber component is cross-linked and cured. The metal mold 11 is in the hermetically sealed state, and therefore the silicone rubber component can be cross-linked and cured while maintaining water content of the water-containing material.

Before the silicone rubber component is cured, in a water vaporization step described later, a non-foam layer (skin layer) having no pore is formed. This skin layer is higher in density than a portion made porous by foaming, and therefore is high in volumetric specific heat, so that the skin layer is not preferable from the viewpoint of the rise time shortening. For that reason, this step may desirably be performed in a state in which the metal mold is hermetically sealed.

(iv) Dewatering Step (Secondary Vulcanizing Step: Formation of Pore Portion)

In this step, the water in the water-containing material is vaporized from the layer formed by cross-linking the rubber in the above-described primary vulcanizing step, and then the porous elastic layer is formed. This step is performed in a state in which an end portion of the metal mold 11 is open. That is, after the cross-linking curing treatment described above, the lower piece mold 6 and the upper piece mold 7 are demounted from the lower and upper ends of the metal mold 5, so that the metal mold 5 is placed in an open state at the end portions thereof. In this state, the inner molded elastic roller (pressing roller) is further heated together with the metal mold 5 to a predetermined high temperature.

By the above heating, with an increasing temperature in the elastic layer 4*b*, the water contained in the water-containing material is vaporized, so that the pore portion 4*b*2 is formed at the portion. As a condition during the heating of the pressing roller 4 in this case, it is desirable that the heating temperature is set at 100° C.-250° C. and the heating time is set at 1 hour-5 hours. In this way, the elastic layer 4*b* including the needle-like filler 4*b*1 and the pore portion 4*b*2 is formed in an outer peripheral surface of the base material 4*a*.

The demounting of the lower piece mold 6 and the upper piece mold 7 from the hollow metal mold 5 is made by pulling out the piece molds 6 and 7 from the hollow metal mold 5 through the one end-side opening 51 and the other end side opening 52, respectively, straightly or white twisting the piece molds 6 and 7 along the openings 51 and 52, respectively. This demounting is made against bond strength of association portion (connecting portion) between an end surface of the cured rubber layer of the elastic roller in the hollow metal mold 5 and the cured rubber layer in the heats 6*b* and 7*b* in the lower piece mold 6 and the upper piece mold 7, respectively.

The pore portion 4*b*2 of the porous elastic layer 4*b* formed on the base material 4*a* as described above is principally in an open cell state in which the pores are connected with each other. Further, the porosity and the open cell rate of the elastic layer 4*b* described above and the open cell of the porous material at the end portions with respect to the length direction y can be adjusted by setting of the heating temperature and a treating time in the above-described steps (i): liquid composition compounding, (iii): primary vulcanizing step and (iv): secondary vulcanizing step.

(v) Demolding of Elastic Roller

After the heated metal mold 5 is cooled by a water cooling method or an air cooling method, the molded elastic roller is demolded from the hollow metal mold 5.

Then, the elastic roller demolded from the hollow metal mold 5 is subjected to reforming for removing burrs and irregularity portion remaining on the one end-side and the other end-side of the elastic layer 4*b*, as desired.

(vi) Formation of Parting Layer

The parting layer 4*c* is formed by coating the elastic layer 4*b* with the fluorine-containing resin-made tube. In order to coat the elastic layer 4*b* with the fluorine-containing resin-made tube, an adhesive is used in general. However, the elastic layer 4*b* and the fluorine-containing resin-made tube can be interlayer-bonded to each other without using the adhesive in some case, and in such cases, the adhesive may also be not used. Further, the parting layer 4*c* may also be formed by applying paint consisting of a fluorine-containing resin material onto an outer peripheral surface of the elastic layer 4*b*.

Figure 12:
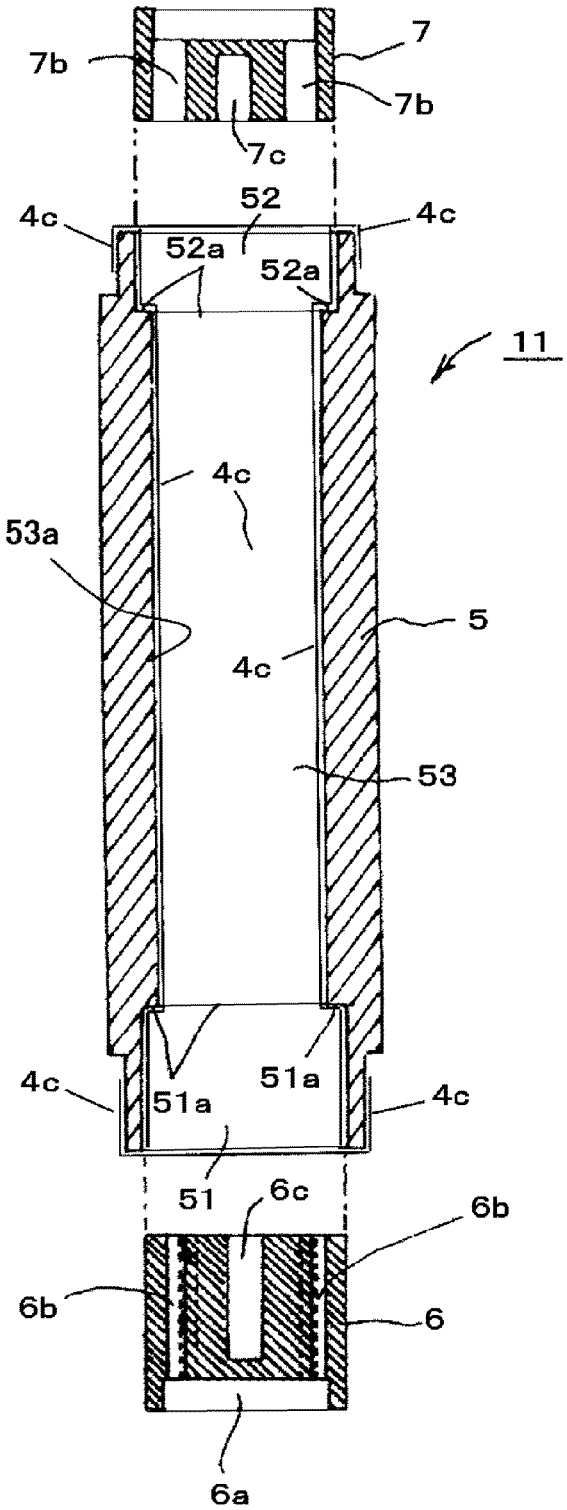
FIG. 12 is a schematic view of a state in which a fluorine-containing resin tube is disposed on an inner surface (forming surface) of the metal mold in advance.

Or, the parting layer 4*c* may also be formed together with the elastic layer 4*b*. That is, as shown in FIG. 12, the fluorine-containing resin tube 4*c* is disposed on an inner surface (forming surface) of the metal mold 5 in advance. Then, inside the metal mold 5, the base material 4*a* is disposed in the manner shown in FIG. 10. Then, between the base material 4*a* and the fluorine-containing resin tube 4*c*, the liquid rubber mixture is caused to flow into, so that the elastic layer 4*b* may also be formed in a state in which the parting layer 4*c* is formed. Incidentally, as the fluorine-containing resin tube 4*c* disposed inside the metal mold, a tube which has been subjected to etching at an inner surface thereof and onto which a primer is applied at the inner surface and then is dried in advance is used.

Here, a parting agent is applied onto a liquid contact surface of each of the lower piece mold 6 and the upper piece mold 7 in advance, and after the demolding, the liquid rubber remaining in each of the piece molds is removed, and then each of the piece molds is used again. When the parting agent is applied in advance, removal of the cured rubber remaining on the associated piece mold is easy. Also onto the molding surface 53*a* of the hollow metal mold 5, the parting agent is applied, whereby the demolding after the rubber curing becomes easy. Further, in the casting step, the metal mold 11 may also assume a horizontal (lateral) attitude or an upside-down attitude. However, in the horizontal attitude or the upside-down attitude, there is a liability that the air is incorporated during the liquid composition injection, and therefore the attitude in which the injection side is positioned in the lower side is preferable.

Embodiments and Comparison Examples

Embodiment 5

In Embodiments, the following materials were used. As the base material 4*a*, an iron-made core metal of 22.8 mm in diameter and 320 mm in widthwise length of the rubber-laminated portion was used. The water-containing material is prepared by incorporating water into "REOGIC 250H" (manufactured by Toagosei Co., Ltd.). The amount of "REOGIC 250H" was adjusted at 1 wt. % per the water-containing material. As the parting layer 4*c*, a 50 μm-thick PFA fluorine-containing resin tube (manufactured by Gunze Limited) which has been treated at an inner surface thereof in advance was used. As the needle-like filler 4*b*1, the pitch-based carbon fibers shown below were used.

<Trade name: XN-100-15M (manufactured by Nippon Graphite Fiber Co., Ltd.)>

Average fiber diameter D: 9 μm

Average fiber length L: 150 μm

Thermal conductivity: 900 W/(m·K)

This needle-like filler is hereinafter referred to as "100-15M".

Incidentally, in this embodiment, bonding between the elastic layer 4*b* and the base material 4*a* and between the elastic layer 4*b* and the parting layer 4*c* is made by the following materials. For the bonding between the elastic layer 4*b* and the base material 4*a*, liquid A and liquid B of "DY39-051" (trade name, manufactured by Dow Corning Toray Co., Ltd.) was used, and for the bonding between the elastic layer 4*b* and the parting layer 4*c*, liquid A and liquid B of "SE1819CV" (trade name, manufactured by Dow Corning Toray Co., Ltd.) was used. In this embodiment, the following steps were performed. In a liquid composition compounding step, the liquid composition was obtained using various materials as described above. Then, the liquid composition was mixed by a universal mixing and stirring device, and the liquid composition for forming the elastic layer was casted into a pipe-shaped cylindrical mold of 30 mm in diameter in which a primer-treated base material 4*a* was disposed, and then the mold was hermetically sealed.

In a silicone rubber component curing step, heat treatment was performed in a hot-air oven under a condition of 90° C. and 1 hour. Then, in a dewatering step, water cooling and demolding were made in advance and the heat treatment was performed in the hot-air oven under a condition of 200° C. and 4 hours. Finally, as the parting layer 4*c*, the PFA fluorine-containing resin material was coated on the elastic layer 4*b* by using the above-described adhesive (bonding agent).

Figure 14:
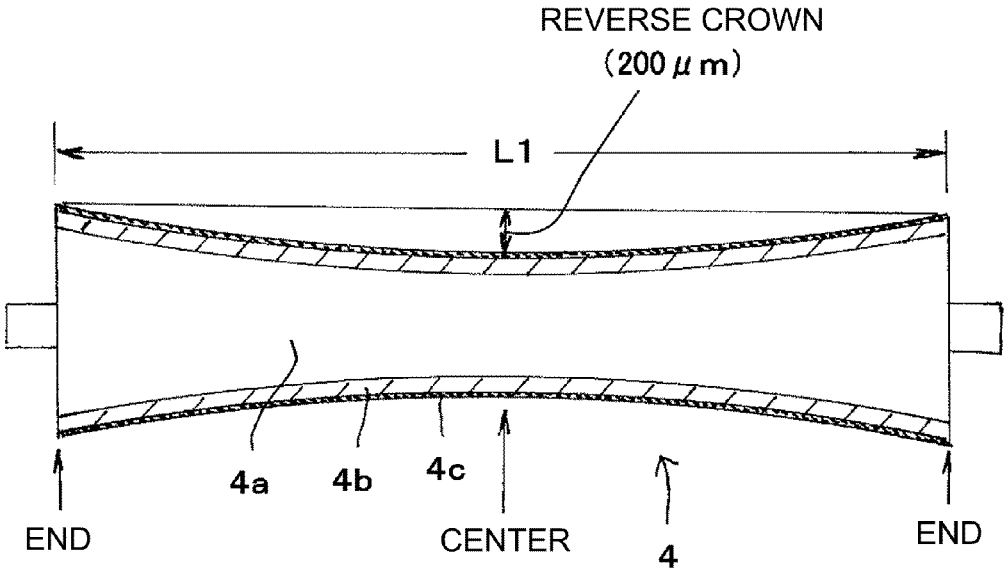
FIG. 14 is a schematic longitudinal sectional view of a pressing roller in embodiments.

Further, each of pressing rollers 4 in Embodiments and Comparison Examples has, as shown in a schematic sectional view of FIG. 14, such a hollow recessed shape that an outer shape (configuration) opposing the fixing film 3 which is the heating member is larger at ends than at a central portion in order to prevent generation of paper creases. That is, the pressing roller 4 has a reverse crown shape in which an end portion outer diameter is larger than a central portion outer diameter. Specifically, the pressing roller 4 is adjusted so that a difference in order diameter between the longitudinal central portion and the longitudinal end portions is 200 μm. That is, the pressing roller 4 is a reverse-crown-shaped roller having a crown amount of 200 μm. Incidentally, FIG. 14 is a schematic exaggerated view, and a dimensional ratio between respective portions does not conform to an actual dimensional ratio.

Embodiments 1-3

In an uncross-linked addition curing type liquid silicone rubber, 5 vol. % of the needle-like filler "100-15M" and 50 vol. % of the water-containing material were mixed to prepare a liquid composition. Then, the liquid composition was casted in the above-described manner and then was subjected to the steps of the curing, the dewatering, the demolding and the parting layer lamination, so that a pressing roller 4*s* in Embodiments 1-3 were obtained. Further, by adjusting the temperature during the dewatering from 100° C. to 250° C., the open cell rates as shown in Table 1 appearing hereinafter were obtained.

Comparison Example 1

In place of the above-described liquid composition, such an addition curing-type silicone rubber that the needle-like filler and the water-containing material were not contained and that the elastic layer 4*b* was 0.4 W/(m·K) in thermal conductivity was used. The manufacturing process was the same as that in Embodiment 1, so that a pressing roller 4 in Comparison Example 1 was obtained. Incidentally, in Comparison Example 1, the pressing roller 4 was manufactured without containing the needle-like filler and the water-containing material, and therefore the elastic layer 4*b* does not include the needle-like filler and the pores.

Comparison Example 2

In place of the above-described liquid composition, an addition curing-type silicone rubber which contained the needle-like filler but which did not contain the water-containing material was used.

A pressing roller 4 in Embodiment 2 was obtained by formulation shown in Table 1 appearing hereinafter in the same manufacturing process as that in Embodiment 1. Incidentally, the elastic layer 4*b* in Comparison Example 2 includes the needle-like filler, but the pressing roller 4 is manufactured without containing the water-containing material and therefore does not include the pores.

(Evaluation 1)

Each of the pressing rollers 4 in Embodiments 1-3 are Comparison Examples 1-4 was incorporated in the fixing device of the filming type, and was subjected to evaluation of the non-sheet-passing portion temperature and the rise time. For evaluation of the non-sheet-passing portion temperature rise, fixing devices A of the film heating type shown in FIG. 1 in which the pressing rollers 4 in Embodiments 1 to 3 and Comparison Examples 1-4 were mounted were used.

A peripheral speed of each of the pressing rollers 4 mounted in the fixing devices A was adjusted at 234 mm/sec, and a heater temperature was set at 220° C. The paper passed, as the sheet P, through the nip N of the fixing device A is LTR-sized paper (long edge feeding, 75 g/m$^2$). The surface temperature of the fixing film 3 in the non-sheet-passing region (region where the LTR-sized paper (long edge feeding) does not pass through the nip N) when 500 sheets are passed was measured. In this case, an expected non-sheet-passing portion temperature rise suppressing effect is that the measured non-sheet-passing portion temperature is lower than that for the pressing roller 4 in Comparison Example 1 in which the ordinary elastic layer is used.

Evaluation of the rise time of the fixing device A was made by measuring a time from turning-on of a heater switch until the surface temperature of the fixing film 3 reached 180° C. in an idling state in which the sheet was not passed through the fixing device A. Here, a rise time shortening effect is that the measured rise time is shortened by 10% compared with that for the pressing roller 4 in Comparison Example 2 in which the non-sheet-passing portion temperature rise suppressing effect is achieved.

(Evaluation 2)

Figure 13:
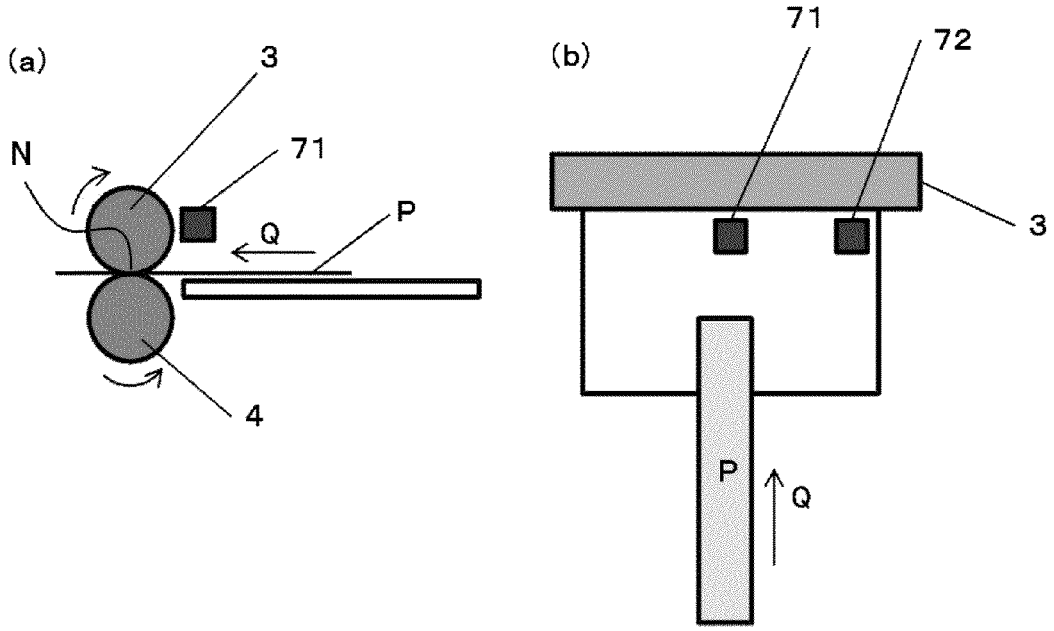
In FIG. 13, (a) and (b) are schematic views of a measuring device of a difference in sheet feeding speed of the pressing roller 4 between a longitudinal central portion and a longitudinal end portion.

In FIG. 13, (a) and (b) are schematic views of a measuring device of a paper feeding speed difference between an end portion and a central portion. A heating member 3 was provided opposed to the pressing roller 4, and in a side upstream of the nip N with respect to the sheet feeding direction Q, laser doppler velocimeters 71 and 72 were provided at the central portion and the end portion, respectively, with respect to the widthwise direction (longitudinal direction) in the neighborhood of the nip N. As described above (FIG. 14), the pressing roller 4 is adjusted so that the outer diameter difference between the longitudinal central portion and the longitudinal end portion is 200 μm. That is, the pressing roller 4 is the reverse crown-shaped roller of 200 μm in crown amount.

A strip paper was passed through each of the central portion and the end portion of the measuring device shown in FIG. 13, and then the speed was measured using the laser doppler velocimeter. The speed difference between the central portion and the end portion is shown in Table 2. In this case, the laser doppler velocimeter used was "LV-20Z" manufactured by Canon Inc.

(Result)

The formulation, the physical properties, the non-sheet-passing portion temperature and the rise time of each of the pressing rollers 4 in Embodiments 1-3 and Comparison Examples 1-4 are shown in Tables 1 and 2.

TABLE 1

| | NLF*1 | | Pore*2 | | | TC*3 | |
|---|---|---|---|---|---|---|---|
| | AL (μm) | Vol. % | Vol. % | CP OCR % | EP OCR % | WD (W/m · K) | TD (W/m · K) |
| EMB. 1 | 150 | 5 | 50 | 4.4 | 90 | 2.5 | 0.08 |
| EMB. 2 | 150 | 5 | 50 | 4.4 | 70 | 2.5 | 0.08 |
| EMB. 3 | 150 | 5 | 50 | 4.4 | 40 | 2.5 | 0.08 |
| COM. EX. 1 | — | 0 | 0 | 0 | 0 | 0.4 | 0.40 |
| COM. EX. 2 | 150 | 12 | 0 | 0 | 0 | 5.5 | 0.40 |
| COM. EX. 3 | 150 | 5 | 10 | 0 | 0 | 2.7 | 0.38 |
| COM. EX. 4 | 150 | 1 | 20 | 0 | 0 | 0.3 | 0.21 |

*1"NLF" is the needle-like filler. "AL" is the average length.
*2"CP" is the central portion. "EP" is the end portion. "OCR %" is the open cell rate (%).
*3"TC" is the thermal conductivity. "WD" is the widthwise direction. "TD" is the thickness direction.

TABLE 2

| | TCR*1 (WD/TD) | VSH*2 (J/cm$^3$ · K) | NSPPT*3 (° C.) | Rise Time (sec) | FSD*4 (mm/s) |
|---|---|---|---|---|---|
| EMB. 1 | 31 | 0.5 | 288 | 11.6 | 0.5 |
| EMB. 2 | 31 | 0.5 | 288 | 11.6 | 1 |
| EMB. 3 | 31 | 0.5 | 288 | 11.6 | 1.5 |
| COMP. EX. 1 | 1 | 1.5 | 310 | 23.7 | 8 |
| COMP. EX. 2 | 14 | 1.6 | 275 | 24.0 | 4 |
| COMP. EX. 3 | 7 | 1.4 | 285 | 23.4 | 6 |
| COMP. EX. 4 | 1 | 1.2 | 314 | 21.1 | 8 |

*1"TCR" is the thermal conductivity ratio. "WD" is the widthwise direction. "TD" is the thickness direction.
*2"VSH" is the volumetric specific heat.
*3"NSPPT" is the non-sheet-passing portion temperature.
*4"FSD" is the feeding speed difference.

In Comparison Example 1, the non-sheet-passing portion temperature is 310° C., and when the non-sheet-passing portion temperature is lower than this temperature, the non-sheet-passing portion temperature rise suppressing effect is achieved.

In Comparison Example 2, the rise time is 24.0 sec, and when the rise time is shorter than 21.6 sec which is shorter than 24.0 sec by 10%, the rise time shortening effect is achieved.

In Embodiments 1-3, the thermal conductivity ratio α is 6 or more, and the thermal conductivity with respect to the widthwise direction y is high by the needle-like filler 4*b*1 oriented in the widthwise direction y, and therefore the non-sheet-passing portion temperature rise suppressing effect was obtained. Further, the volumetric specific heat in the region from the surface of the elastic layer 4*b* to the position of 500 μm in depth from the elastic layer surface is 1.2 J/cm$^3$·K, and therefore also the rise time shortening effect was obtained.

In Comparison Example 3, although the non-sheet-passing portion temperature rise suppressing effect is obtained, the volumetric specific heat in the region from the surface of the elastic layer 4*b* to the position of 500 μm in depth from the elastic layer surface is high, so that the rise time shortening effect was not obtained.

In Comparison Example 4, although the rise time shortening effect is obtained, the thermal conductivity ratio α is low, so that the effect by the oriented needle-like filler 4*b*1 is not achieved and therefore the non-sheet-passing portion temperature rise suppressing effect is not obtained.

In Embodiments 1-3, the rise time shortening and the non-sheet-passing portion temperature rise suppression by ensuring of the thermal conductivity with respect to the widthwise direction y by the needle-like filler 4*b*1 and the decrease in thermal capacity by the pores 4*b*2 were observed, and by increasing the end portion open cell rate, it was possible to make the paper feeding speed difference small.

The constitution of the pressing roller 4 in the above-described Embodiments 1-3 is summarized as follows. The pressing roller 4 is the nip-forming member which includes the base material 4*a* and the elastic layer 4*b* formed on the base material 4*a* and which forms the nip N, where the sheet position carrying thereon the toner image T is nip-fed and heated, by elastic deformation of the elastic layer 4*b* by the press-contact with the heating member 3.

The elastic layer 4*b* is the porous elastic layer containing the needle-like filler 4*b*1 and has the thermal conductivity so that the thermal conductivity λ1 with respect to the length direction y is 6 times or more and 600 times or less the thermal conductivity λ2 with respect to the thickness direction α. In addition, the elastic layer 4*b* is characterized in that the volumetric specific heat in the region from the surface to the position of 500 μm in depth from the surface is 0.5 $J/cm^3 \cdot K$ or more and 1.2 $J/cm^3 \cdot K$ or less, the porosity is 10 volume % or more and 70 volume % or less, and the open cell rate of the porous material at the end portion with respect to the length direction y is 40% or more and 90% or less.

As a result, it is possible to provide the pressing roller 4 which is capable of shortening the rise time while suppressing the non-sheet-passing portion temperature rise and for which a trailing end leap of the paper does not readily generate, and to provide an image heating apparatus including the pressing roller 4.

Other Embodiments

1) In Embodiments 1-3 described above, an example in which the pressing roller 4 which is the rotatable member is used as the fixing member was described, but the present invention is not limited thereto. For example, the fixing member 4 may also be in the form of an endless pressing belt which is the rotatable member. Specifically, as the base material 4*a*, the endless (belt-shaped) member of a thin heat-resistant resin such as polyimide, polyamideimide or polyether ether ketone (PEEK) or a thin metal material such as stainless steel (SUS) or nickel (Ni) is used. In the belt form, on this base material, the elastic layer 4*b* having the above-described constitution is formed.

Further, the fixing member may also have a constitution in which the member is disposed in a side where the member contacts the toner image formed on the recording material (i.e., corresponds to the fixing film 3 described above).

Figure 15:
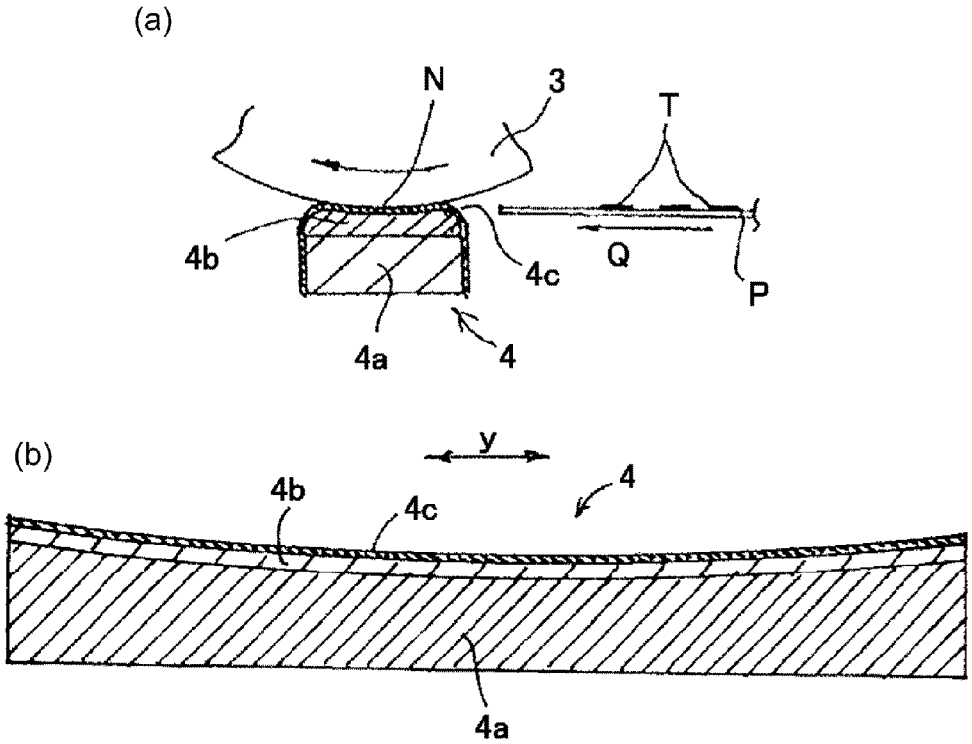
In FIG. 15, (a) and (b) are schematic structural views each showing a nip-forming member of a non-rotation type.

2) The form of the fixing member 4 is not limited to the form of the rotatable member described above. The form may also be changed to the form of the heating member 3 to be rotationally driven or the form of a non-rotatable member such as an elongated pad-like member, as shown in FIG. 15, having a smaller surface friction coefficient than that of the recording material P.

The recording material P introduced into the nip N is gradually nip-fed through the nip N by a rotational feeding force of the heating member 3 while sliding, in a back surface side (non-image forming surface side), on the surface of the nip-forming member 4 which is in the form of the non-rotatable member and which is small in friction coefficient.

3) The heating type is not limited to the type using the ceramic heater but may also be a heat radiation type using a halogen lamp or the like, an electromagnetic induction heating type, another heat radiation type or the like. The heating type is also not limited to an internal heating type but may also be an outer heating type.

4) The toner image forming principle and process on the recording material P are not limited to an electrophotographic process. An electrophotographic process of a direct type using photosensitive paper as the recording material may also be used. An electrostatic recording process of a transfer type using a dielectric member as the image bearing member or of a direct type, and a magnetic recording process of an intermediary transfer type using a magnetic material or of a direct type, and the like process may be used.

5) The image heating apparatus may also embrace, in addition to the fixing device for fixing the unfixed toner image as the fixed image as in Embodiments, an image quality modifying device for improving glossiness or the like by re-heating and pressing the toner image temporarily fixed or once heat-fixed on the recording material.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-145829 filed on Jul. 16, 2014, which is hereby incorporated by reference herein in its entirety.

What is claimed is:

1. A fixing member, comprising:

a base layer; and a porous elastic layer provided on said base layer, wherein said elastic layer contains a needle-like filler so that a thermal conductivity of said elastic layer, with respect to a longitudinal direction thereof, is 6 times to 900 times a thermal conductivity with respect to a thickness direction thereof, and wherein said elastic layer has an open cell rate of 40-90% at longitudinal end portions, which is larger than an open cell rate at a longitudinal central portion.

2. The fixing member according to claim 1, wherein in a region of said elastic layer from a surface to a position of 500 μm in depth from the surface, said elastic layer has a volumetric specific heat of 0.5-1.2 $J/cm^3 \cdot K$ or less and has a porosity of 10-70 volume %.

3. The fixing member according to claim 1, wherein said elastic layer contains the needle-like filler in an amount of 5-40 volume %.

4. The fixing member according to claim 1, wherein the needle-like filler has a thermal conductivity of 500-900 $W/(m \cdot K)$.

5. The fixing member according to claim 4, wherein the needle-like filler contains carbon fibers.

6. The fixing member according to claim 4, wherein the needle-like filler is 50-1000 μm in average length with respect to a longitudinal direction of the needle-like filler.

7. The fixing member according to claim 1, further comprising a fluorine-containing resin layer provided on said elastic layer.

8. The fixing member according to claim 1, wherein said fixing member is contactable to an opposite surface of the recording material from a toner image-formed surface of the recording material.

* * * * *